US011347159B2

(12) United States Patent
Kasuya et al.

(10) Patent No.: US 11,347,159 B2
(45) Date of Patent: May 31, 2022

(54) LIGHT EMITTING DEVICE AND RENDERING DEVICE

(71) Applicant: FUJIFILM Business Innovation Corp., Tokyo (JP)

(72) Inventors: Yosuke Kasuya, Kanagawa (JP); Takahiko Kobayashi, Kanagawa (JP); Tsutomu Otsuka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/077,717

(22) Filed: Oct. 22, 2020

(65) Prior Publication Data

US 2021/0302865 A1 Sep. 30, 2021

(30) Foreign Application Priority Data

Mar. 25, 2020 (JP) ..... JP2020-054935

(51) Int. Cl.
*G03G 15/04* (2006.01)
*B41J 2/45* (2006.01)
*B41J 2/455* (2006.01)

(52) U.S. Cl.
CPC ..... *G03G 15/04054* (2013.01); *B41J 2/45* (2013.01); *B41J 2/451* (2013.01); *B41J 2/455* (2013.01); *G03G 15/04063* (2013.01); *G03G 15/04072* (2013.01); *G03G 2215/0409* (2013.01); *G03G 2215/0412* (2013.01)

(58) Field of Classification Search
CPC ..... G03G 15/04054; G03G 15/04063; G03G 15/04072; G03G 2215/0404; G03G 2215/0409; G03G 2215/0412; B41J 2/45; B41J 2/455
See application file for complete search history.

(56) References Cited

U.S. PATENT DOCUMENTS 9,981,482 B2 5/2018 Tanaka
2015/0370193 A1* 12/2015 Okazaki ..... G03G 15/0409 347/118
2016/0070230 A1* 3/2016 Kokubu ..... G03G 21/206 399/92

FOREIGN PATENT DOCUMENTS

JP 2017-177664 A 10/2017

* cited by examiner

*Primary Examiner* — Matthew Luu
*Assistant Examiner* — Kendrick X Liu
(74) *Attorney, Agent, or Firm* — Sughrue Mion, PLLC

(57) ABSTRACT

A light emitting device includes: a base plate extending in a first direction; a plurality of light emitting units arranged over a front surface of the base plate while being shifted from each other in the first direction, and each including a support body extending in the first direction and a plurality of light sources supported on the support body while being arranged in the first direction; a flow path disposed on a side of the base plate opposite to a side facing the light emitting units to feed air therethrough in the first direction; and a wire electrically connected to at least one of the plurality of the light emitting units, and disposed inside the flow path.

17 Claims, 16 Drawing Sheets

LIGHT EMITTING DEVICE AND RENDERING DEVICE

CROSS-REFERENCE TO RELATED APPLICATIONS

This application is based on and claims priority under 35 USC 119 from Japanese Patent Application No. 2020-054935 filed Mar. 25, 2020.

BACKGROUND

(i) Technical Field

The present disclosure relates to a light emitting device and a rendering device.

(ii) Related Art

Japanese Unexamined Patent Application Publication No. 2017-177664 discloses a light exposure device that includes a first light exposure head and a second light exposure head. The first light exposure head includes multiple first light emitting devices, which are arranged in a first direction to emit first light beams, a first optical system, which is disposed to face the multiple first light emitting devices in a second direction crossing the first direction and forms the multiple first light beams emitted from the multiple first light emitting devices into images, a first joint, and a first base plate that supports the multiple first light emitting devices, the first optical system, and the first joint. The second light exposure head includes multiple second light emitting devices, which are arranged in the first direction to each emit second light beams, a second optical system, which is disposed to face the multiple second light emitting devices in the second direction to form the multiple second light beams emitted from the multiple second light emitting devices into images, a second joint that fits to the first joint, and a second base plate that supports the multiple second light emitting devices, the second optical system, and the second joint. In the light exposure device, the first joint is located on the first base plate at a first position corresponding to an imaging position of the first optical system, and the second joint is located on the second base plate at a second position corresponding to an imaging position of the second optical system.

SUMMARY

Aspects of non-limiting embodiments of the present disclosure relate to obtaining a light emitting device and a rendering device that further reduces damages on wires caused when the light emitting device falls sideways than in a structure including wires disposed further outward from a base plate in a width direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a light emitting device including a base plate extending in a first direction, multiple light emitting units arranged over a front surface of the base plate while being shifted from each other in the first direction, and each including a support body extending in the first direction and multiple light sources supported on the support body while being arranged in the first direction, a flow path disposed on a side of the base plate opposite to a side facing the light emitting units to feed air therethrough in the first direction, and a wire electrically connected to at least one of the multiple light emitting units, and disposed inside the flow path.

BRIEF DESCRIPTION OF THE DRAWINGS

Exemplary embodiments of the present disclosure will be described in detail based on the following figures, wherein.

DETAILED DESCRIPTION

Hereinbelow, forms embodying the present disclosure (referred to as exemplary embodiments, below) will be described.

First Exemplary Embodiment

Image Forming Apparatus 10

Figure 1:
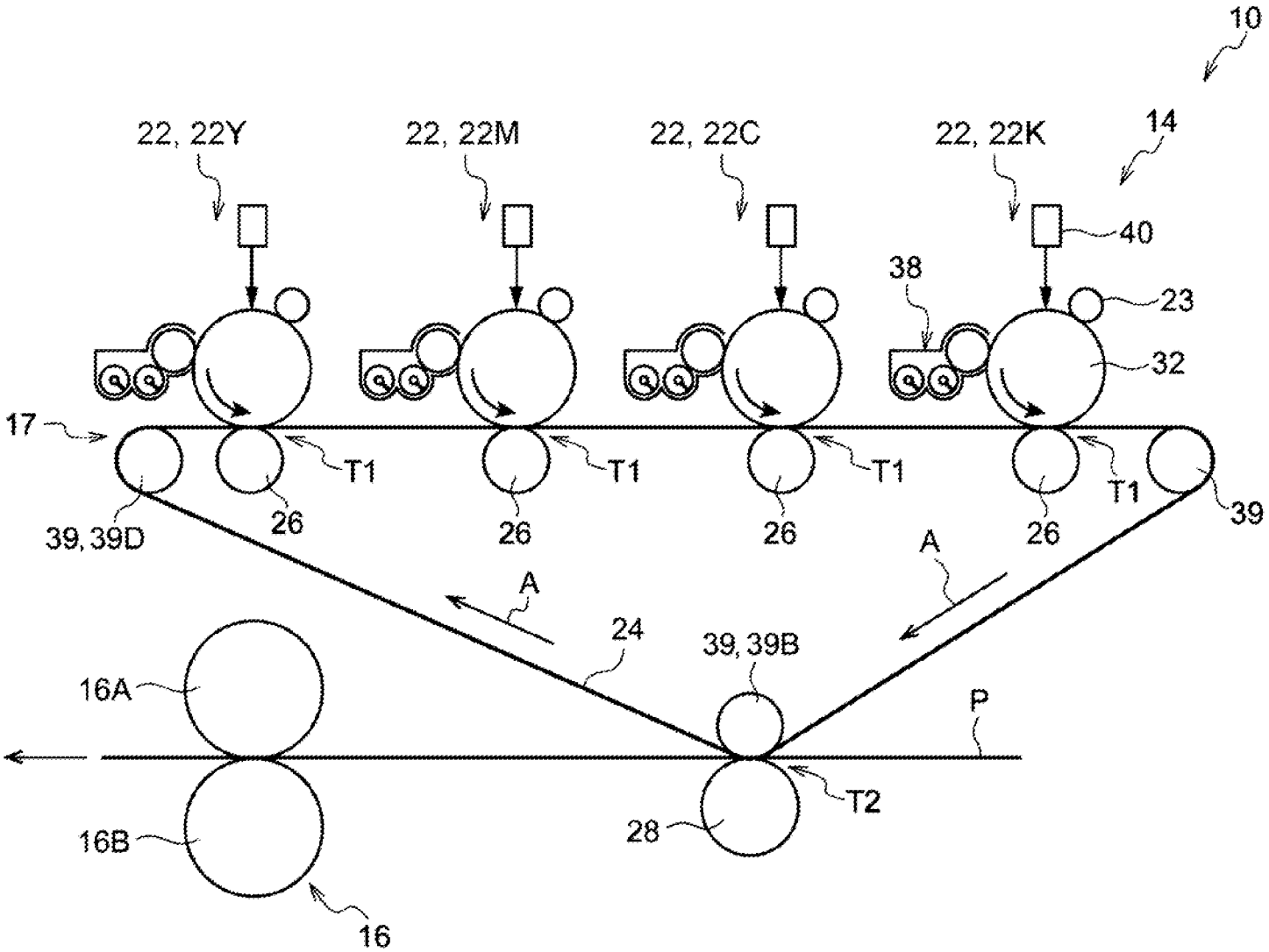
FIG. 1 is a schematic diagram of an image forming apparatus including a light exposure device according to a first exemplary embodiment.

FIG. 1 is a schematic diagram of a structure of an image forming apparatus 10 including light exposure devices 40 according to a first exemplary embodiment. First, the structure of the image forming apparatus 10 will be described. Subsequently, the light exposure devices 40 included in the image forming apparatus 10 will be described. Here, the image forming apparatus 10 is an example of a rendering device, and each light exposure device 40 is an example of a light emitting device. The image forming apparatus 10 is, for example, an image forming apparatus forming images with multiple colors, and is, for example, a full-color printer for commercial printing requiring high quality in particular.

The image forming apparatus 10 is a wide image forming apparatus that handles a width exceeding the width of a recording medium P in B3 longitudinal feed (that is, width exceeding 364 mm). For example, the image forming apparatus 10 handles a recording medium P with 420 mm or greater in A2 longitudinal feed and with 1456 mm or smaller in B0 cross feed. For example, the image forming apparatus 10 handles 728 mm in B2 cross feed.

The image forming apparatus 10 illustrated in FIG. 1 is an example of an image forming apparatus that forms an image on a recording medium. Specifically, the image forming apparatus 10 is an electrophotographic image forming apparatus that forms a toner image (example of an image) on a recording medium P. Toner is an example of powder. More specifically, the image forming apparatus 10 includes an image forming unit 14 and a fixing device 16. Hereinbelow, each components of the image forming apparatus 10 (the image forming unit 14 and the fixing device 16) will be described.

Image Forming Unit 14

The image forming unit 14 has a function of forming a toner image on the recording medium P. Specifically, the image forming unit 14 includes toner image forming units 22 and a transfer device 17.

Toner Image Forming Units 22

The multiple toner image forming units 22 illustrated in FIG. 1 form images of respective colors. The present exemplary embodiment includes four toner image forming units 22 for yellow (Y), magenta (M), cyan (C), and black (K). In FIG. 1, Y, M, C, and K appended to the reference signs correspond to components for the respective colors.

The toner image forming units 22 for the respective colors have the same structure excluding the toner used in each unit. Thus, components of the toner image forming unit 22K are denoted with reference signs in FIG. 1 as a representative of the toner image forming units 22Y, 22M, 22C, and 22K for the respective colors.

Each of the toner image forming units 22 for the respective colors specifically includes a photoconductor drum 32, which rotates in the first direction (for example, counterclockwise in FIG. 1). Here, the photoconductor drum 32 is an example of a cylindrical member, and a photoconductor on the surface of the photoconductor drum 32 is an example of an area over which a photoconductor material is disposed. Each of the toner image forming units 22 for the respective colors also includes a charging device 23, the light exposure device 40, and a developing device 38.

In each of the toner image forming units 22 for the respective colors, the charging device 23 electrically charges the photoconductor drum 32. The light exposure device 40 exposes the photoconductor drum 32 electrically charged by the charging device 23 to light to form an electrostatic latent image on the photoconductor drum 32. The developing device 38 develops an electrostatic latent image formed on the photoconductor drum 32 by the light exposure device 40 into a toner image.

The photoconductor drum 32 rotates while carrying the electrostatic latent image thus formed on its outer circumference to transport the electrostatic latent image to the developing device 38. A specific structure of the light exposure device 40 will be described later.

Transfer Device 17

The transfer device 17 illustrated in FIG. 1 is a device that transfers the toner image formed by each toner image forming unit 22 to a recording medium P. Specifically, the transfer device 17 first-transfers the toner images on the photoconductor drums 32 for the respective colors onto a transfer belt 24, serving as an intermediate transfer body, in a superposed manner, and second-transfers the superposed toner images to the recording medium P. Specifically, as illustrated in FIG. 1, the transfer device 17 includes the transfer belt 24, first transfer rollers 26, and a second transfer roller 28.

Each first transfer roller 26 is a roller that transfers the toner image on the corresponding photoconductor drum 32 to the transfer belt 24 at a first transfer position T1 between the photoconductor drum 32 and the first transfer roller 26. In the present exemplary embodiment, a first transfer electric field is imposed between the first transfer roller 26 and the photoconductor drum 32, so that the toner image on the photoconductor drum 32 is transferred to the transfer belt 24 at the first transfer position T1.

The transfer belt 24 has an outer peripheral surface that receives toner images from the respective photoconductor drums 32. Specifically, the transfer belt 24 has the following structure. As illustrated in FIG. 1, the transfer belt 24 is annular and fixed in position while being wound around multiple rollers 39.

The transfer belt 24 rotates in the direction of arrows A by, for example, a driving roller 39D among the multiple rollers 39 being driven to rotate by a driving unit (not illustrated). A roller 39B among the multiple rollers 39 illustrated in FIG. 1 is an opposing roller 39B, which opposes the second transfer roller 28.

The second transfer roller 28 is a roller that transfers the toner images transferred to the transfer belt 24 to the recording medium P at a second transfer position T2 between the opposing roller 39B and the second transfer roller 28. In the present exemplary embodiment, a second transfer electric field is imposed between the opposing roller 39B and the second transfer roller 28, so that the toner image transferred to the transfer belt 24 is transferred to the recording medium P at the second transfer position T2.

Fixing Device 16

The fixing device 16 illustrated in FIG. 1 is a device that fixes a toner image transferred to the recording medium P by the second transfer roller 28 onto the recording medium P. Specifically, as illustrated in FIG. 1, the fixing device 16 includes a heating roller 16A, serving as a heating member, and a pressing roller 16B, serving as a pressing member. The fixing device 16 heats and presses the recording medium P with the heating roller 16A and the pressing roller 16B to fix the toner image formed on the recording medium P onto the recording medium P.

Light Exposure Device 40

Figure 2:
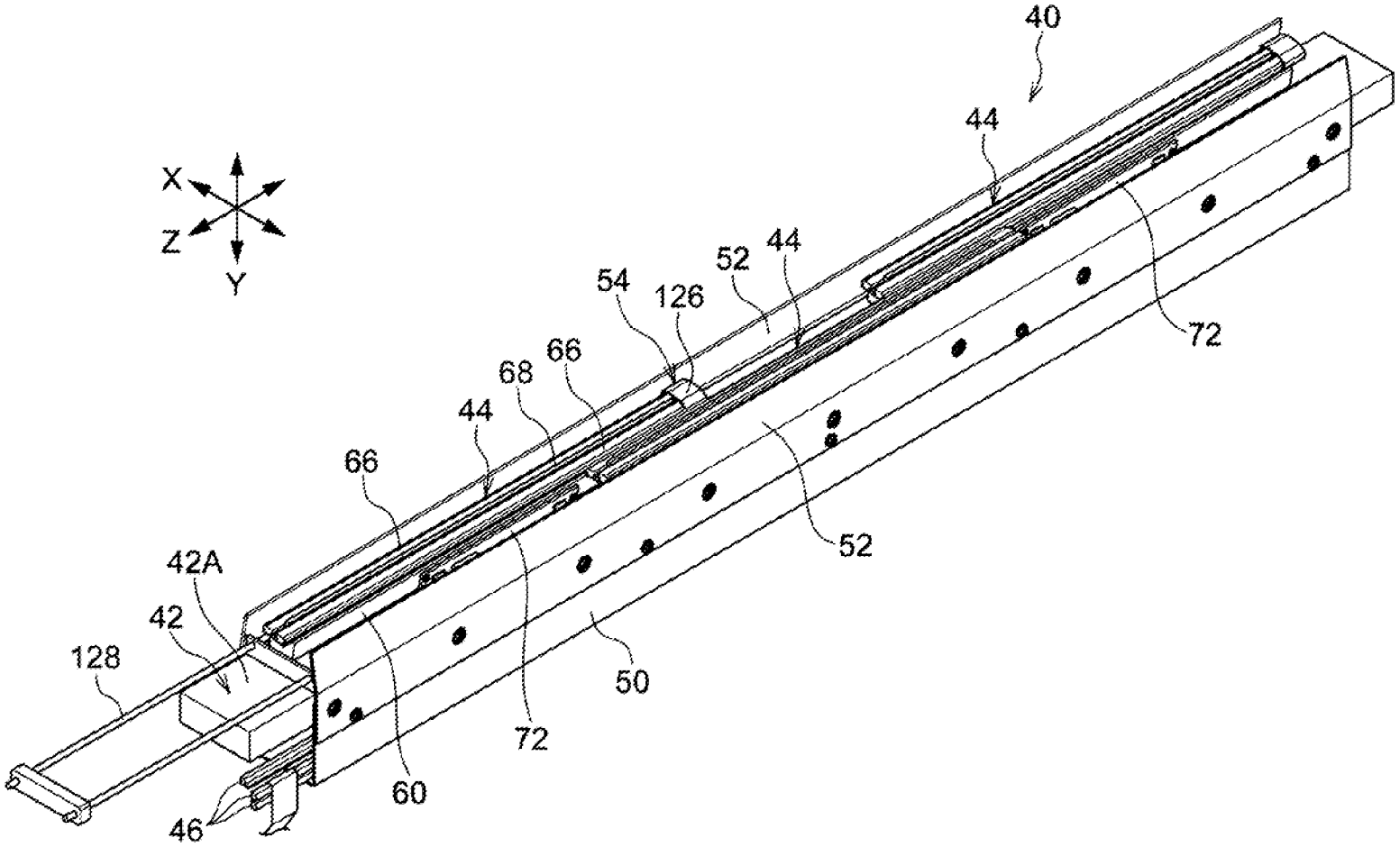
FIG. 2 is a perspective view of the light exposure device included in the image forming apparatus.
Figure 3:
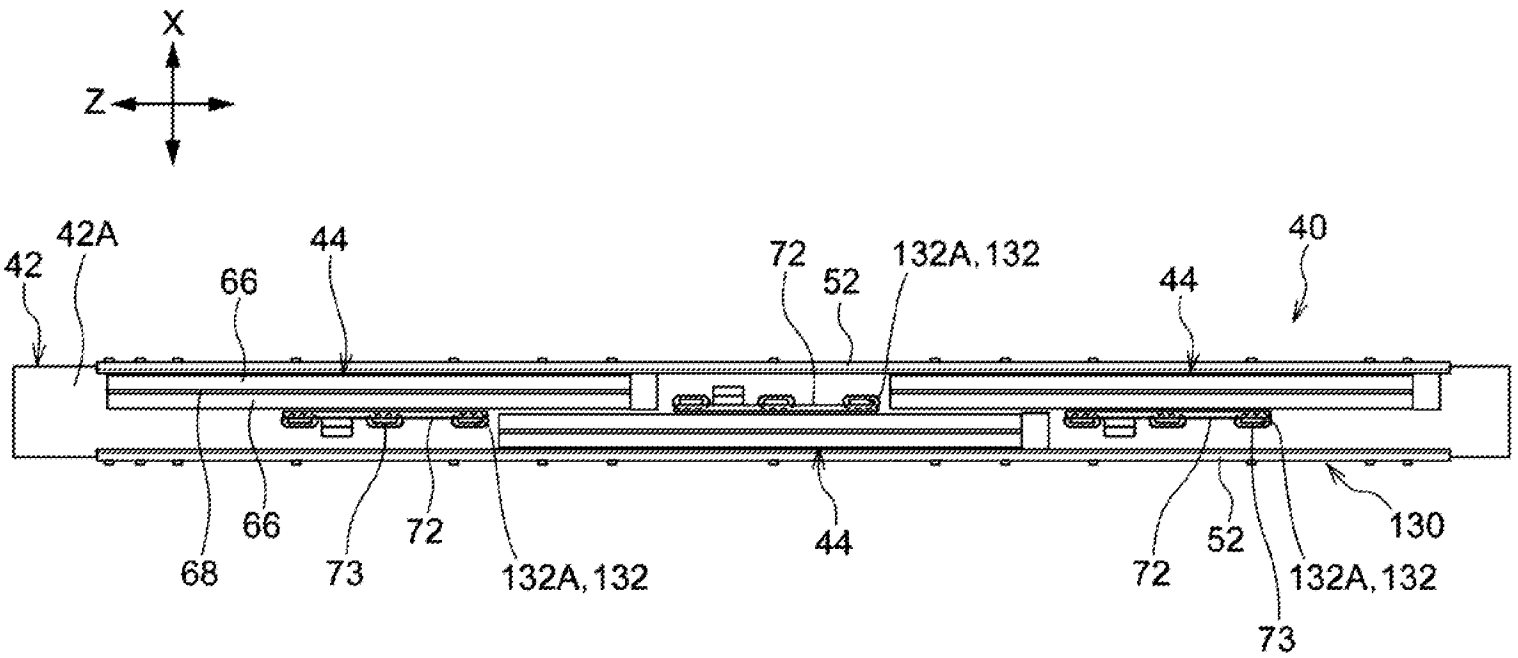
FIG. 3 is a diagram of a structure of the light exposure device, viewed from above.

Subsequently, the structure of each light exposure device 40, which is a related portion of the present exemplary embodiment, will be described. FIG. 2 is a perspective view of the structure of the light exposure device 40. FIG. 3 is a plan view of the light exposure device 40 viewed from above. In the following description, the direction of arrow X in the drawings is described as a width direction of the light exposure device 40, and the direction of arrow Y is described as a height direction of the light exposure device 40. The direction of arrow Z perpendicular to the device width direction and the device height direction is described as a depth direction of the light exposure device 40. The width direction and the height direction are defined for ease of illustration, and the structure of the light exposure device 40 is not limited by these directions.

Entire Structure of Light Exposure Device 40

First, the entire structure of each light exposure device 40 will be described, and then, components of the light exposure device 40 will be described.

As illustrated in FIG. 2 and FIG. 3, each light exposure device 40 includes a base plate 42 extending in a first direction (direction of arrow Z in the present exemplary embodiment), and multiple light emitting units 44 disposed on a first side (vertically upper side in FIG. 2 and FIG. 3) of the base plate 42 in the direction of arrow Y. The present exemplary embodiment includes three light emitting units 44 extending in the first direction of the base plate 42. The base plate 42 is a long rectangular member in a plan view in FIG. 2. The light emitting units 44 have the same structure, and are long rectangular members in a plan view in FIG. 3. The length of each light emitting unit 44 in the first direction (that is, longitudinal direction) is smaller than the length of the base plate 42 in the first direction (that is, longitudinal direction).

For example, the three light emitting units 44 are arranged while being shifted from each other in the first direction (direction of arrow Z) of the base plate 42, and being shifted in the width direction perpendicular to the first direction of the base plate 42, that is, shifted in the cross direction (direction of arrow X) of the base plate 42. The light exposure device 40 is disposed to extend in the axial direction of the photoconductor drum 32 (refer to FIG. 1), and the length of the light exposure device 40 in the first direction (direction of arrow Z) is greater than the length of the photoconductor drum 32 in the axial direction. At least one of the three light emitting units 44 opposes the area of the surface of the photoconductor drum 32 over which a photoconductor is disposed. Thus, the surface of the photoconductor drum 32 is irradiated with light emitted from the light exposure device 40.

In FIGS. 2 and 3 and other drawings of the light exposure device 40, the light emitting units 44 on the base plate 42 are located on the vertically upper side to emit light upward. However, in the image forming apparatus 10 illustrated in FIG. 1, the light exposure device 40 is disposed upside down in the vertical direction. Specifically, in FIG. 1, the light exposure device 40 is disposed while having the side of the base plate 42 receiving the light emitting units 44 on the vertically lower side, and having the light emitting units 44 emit light toward the photoconductor drum 32 on the lower side.

In the present exemplary embodiment, the three light emitting units 44 are staggered when viewed from above in the vertical direction of the light exposure device 40 (refer to FIG. 3). More specifically, two light emitting units 44 are arranged at both end portions of the base plate 42 in the first direction (direction of arrow Z) on a first side of the base plate 42 in the cross direction (direction of arrow X). At a middle portion of the base plate 42 in the first direction (direction of arrow Z), one light emitting unit 44 is arranged over a second side of the base plate 42 in the cross direction (direction of arrow X). The end portions of the two light emitting units 44 arranged over the first side of the base plate 42 in the cross direction (direction of arrow X) and the end portions of the one light emitting unit 44 arranged over the second side of the base plate 42 in the cross direction (direction of arrow X) overlap each other when viewed in the cross direction (direction of arrow X) of the base plate 42. Specifically, in the first direction (direction of arrow Z) of the base plate 42, the areas from which the three light emitting units 44 emit light partially overlap.

The two light emitting units 44 arranged over the first side of the base plate 42 in the cross direction (direction of arrow X) and the one light emitting unit 44 arranged over the second side of the base plate 42 in the cross direction (direction of arrow X) do not overlap when viewed in the first direction (direction of arrow Z) of the base plate 42.

Figure 4:
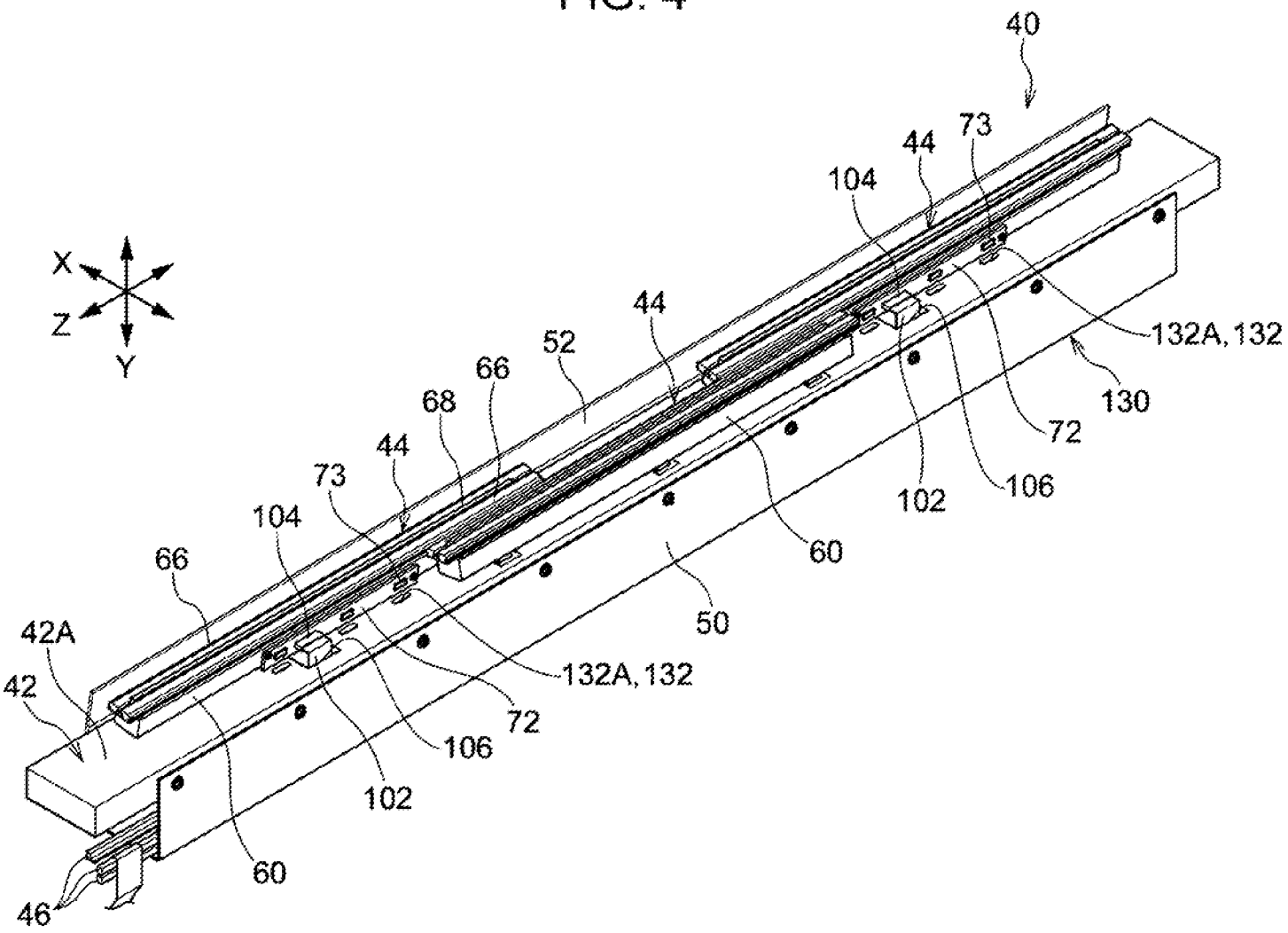
FIG. 4 is a perspective view of multiple light emitting units of the light exposure device.
Figure 5:
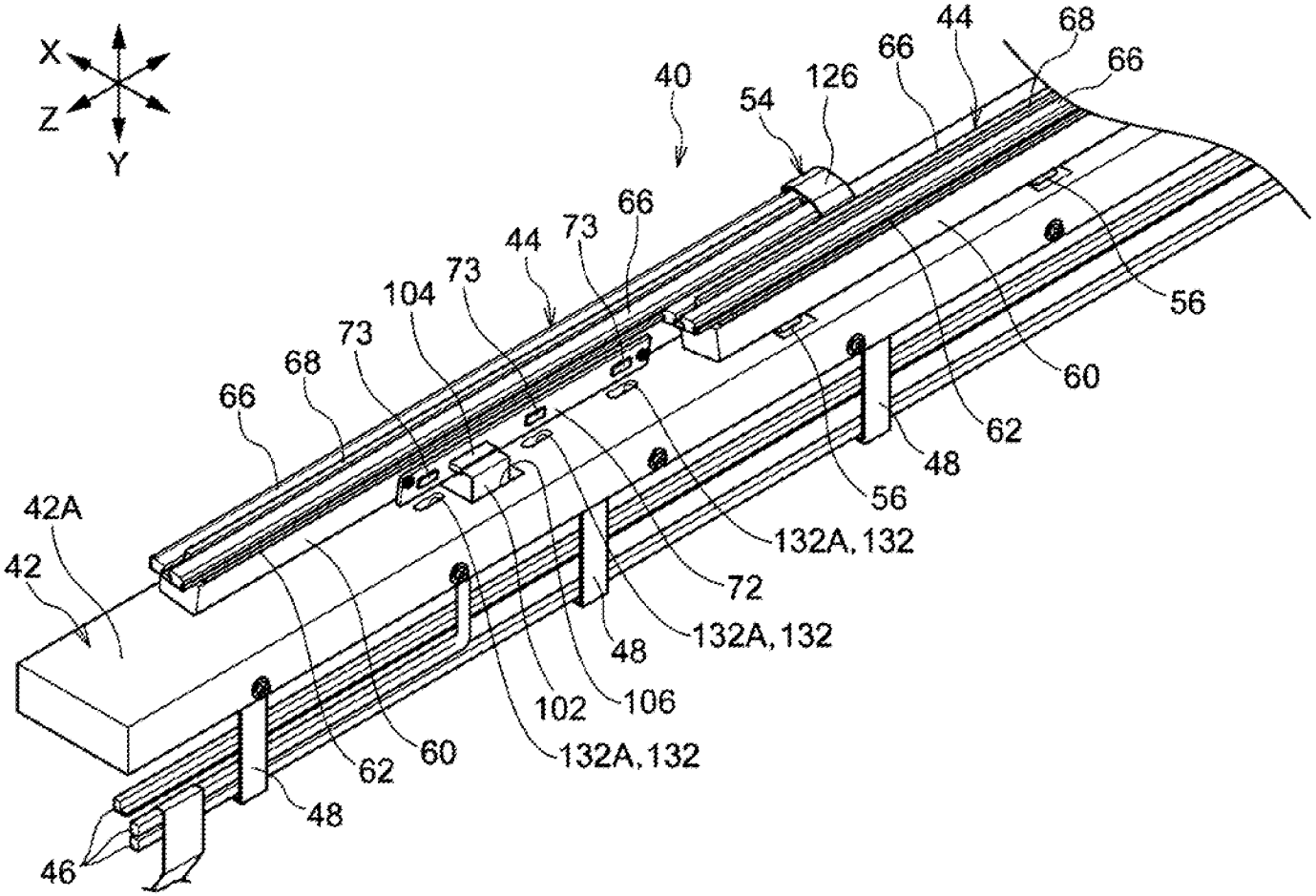
FIG. 5 is a partially enlarged perspective view of the light exposure device.

As illustrated in FIG. 4 and FIG. 5, the light exposure device 40 includes harnesses 46, electrically connected to the three light emitting units 44, respectively, multiple brackets 48 that hold the harnesses 46, and a lower covering 50 that covers the harnesses 46 and the brackets 48 from the outer side. Each of the harnesses 46 is a set of multiple wires in a bundle for power supply. The brackets 48 are attached to the base plate 42, and extend from the base plate 42 to a second side in the direction of arrow Y (to the lower side in the vertical direction in FIG. 2). The lower covering 50 is attached to the second side of the base plate 42 in the direction of arrow Y (to the lower side in the vertical direction in FIG. 2).

As shown in FIG. 2 and FIG. 3, the light exposure device 40 includes side coverings 52, covering the sides of the three light emitting units 44. The side coverings 52 are flat, and have lower end portions attached to both sides of the base plate 42 in the cross direction (direction of arrow X). The light exposure device 40 also includes cleaning devices 54, which clean lens units 68 of the light emitting units 44. The lens units 68 will be described later.

Figure 6:
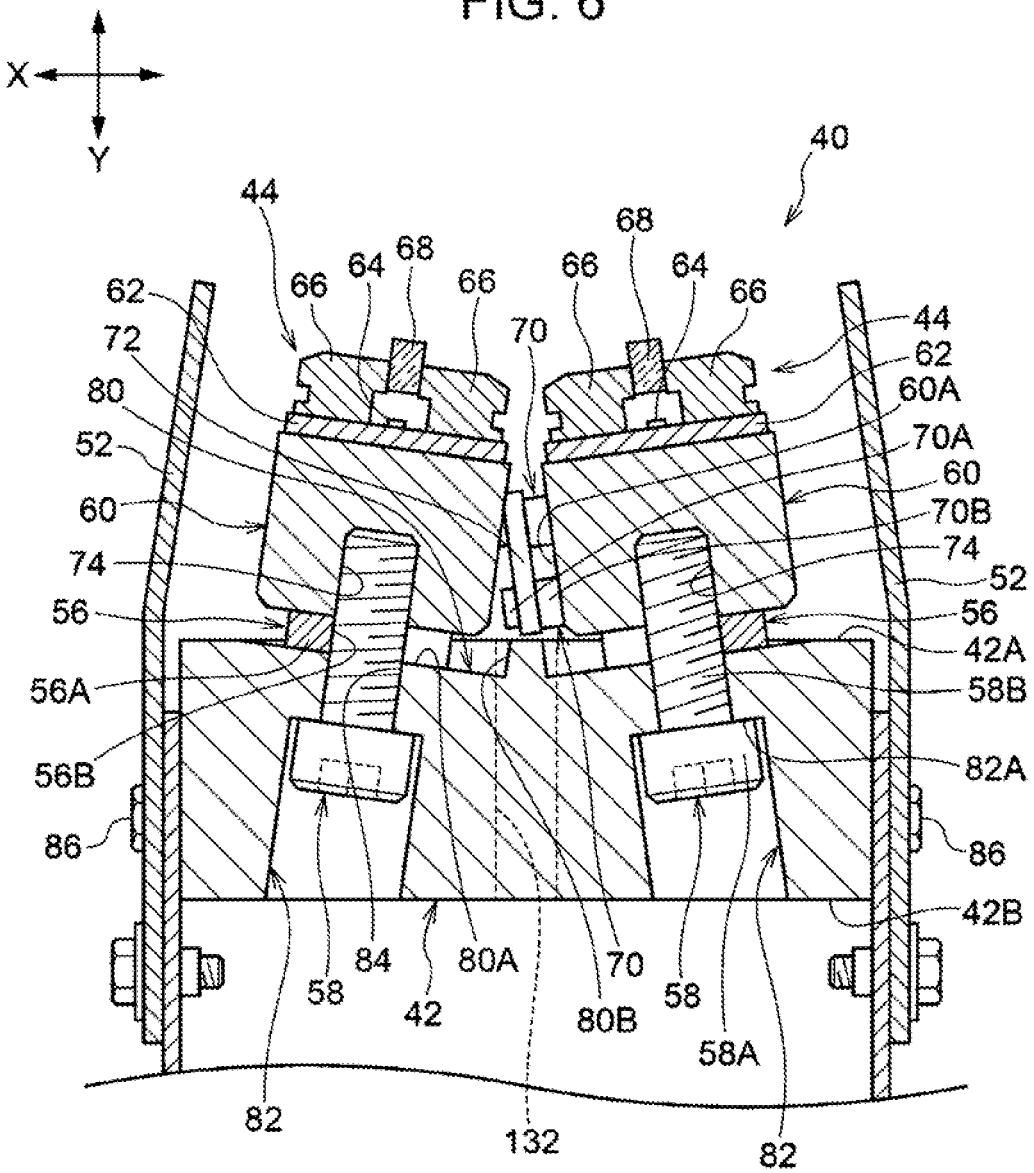
FIG. 6 is a cross-sectional view of the multiple light emitting units of the light exposure device taken in a cross direction.

As illustrated in FIG. 5 and FIG. 6, the light exposure device 40 also includes multiple spacers 56, interposed between the base plate 42 and the light emitting units 44, and fastening members 58, which secure the light emitting units 44 to the base plate 42 while having the multiple spacers 56 interposed therebetween. Examples of the fastening members 58 are members having a helical groove used for fastening. In other words, examples of the fastening members 58 are components having a screw mechanism, and include screws and bolts.

Figure 7:
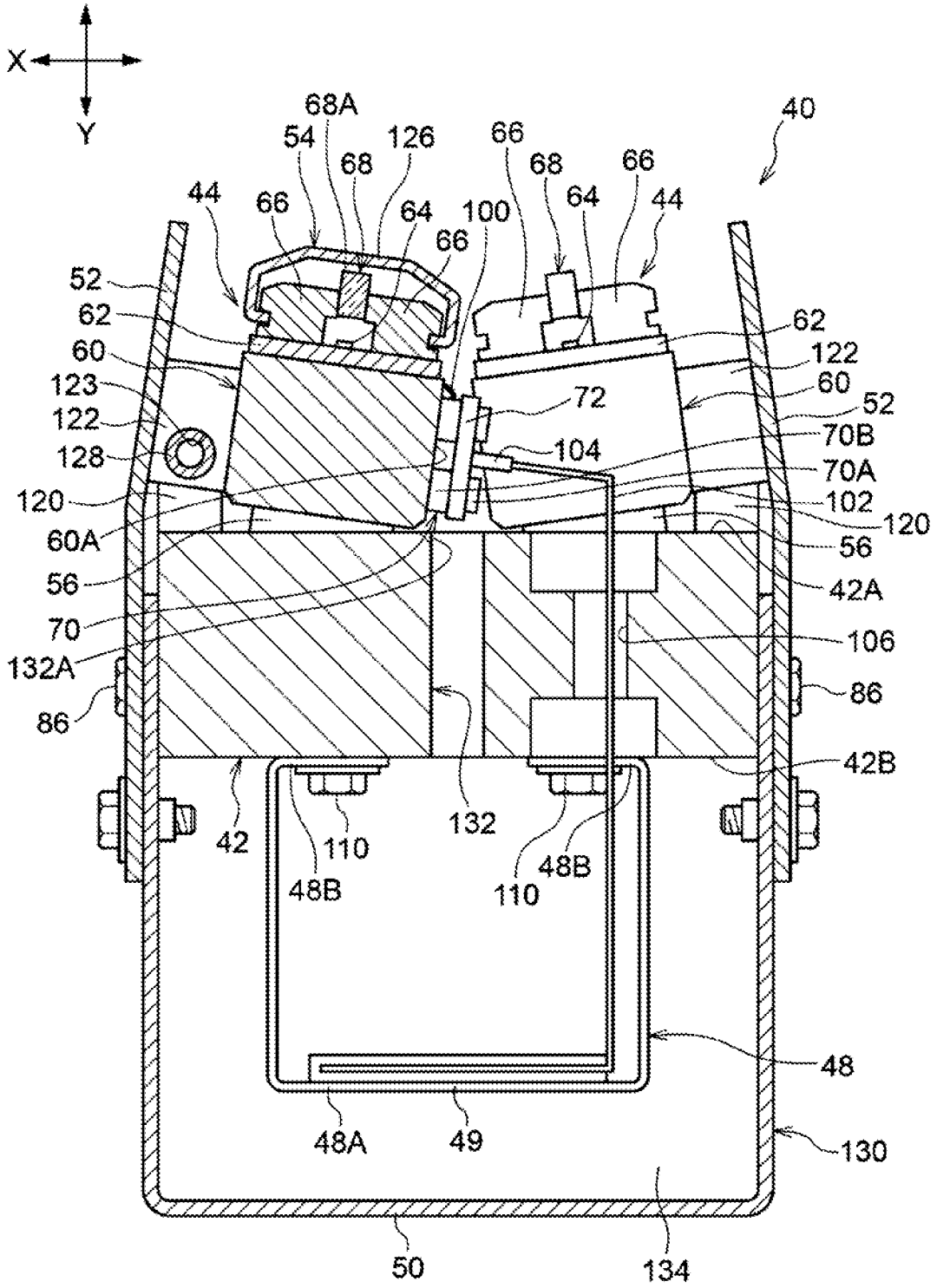
FIG. 7 is a cross-sectional view of the light exposure device taken in the cross direction.
Figure 8:
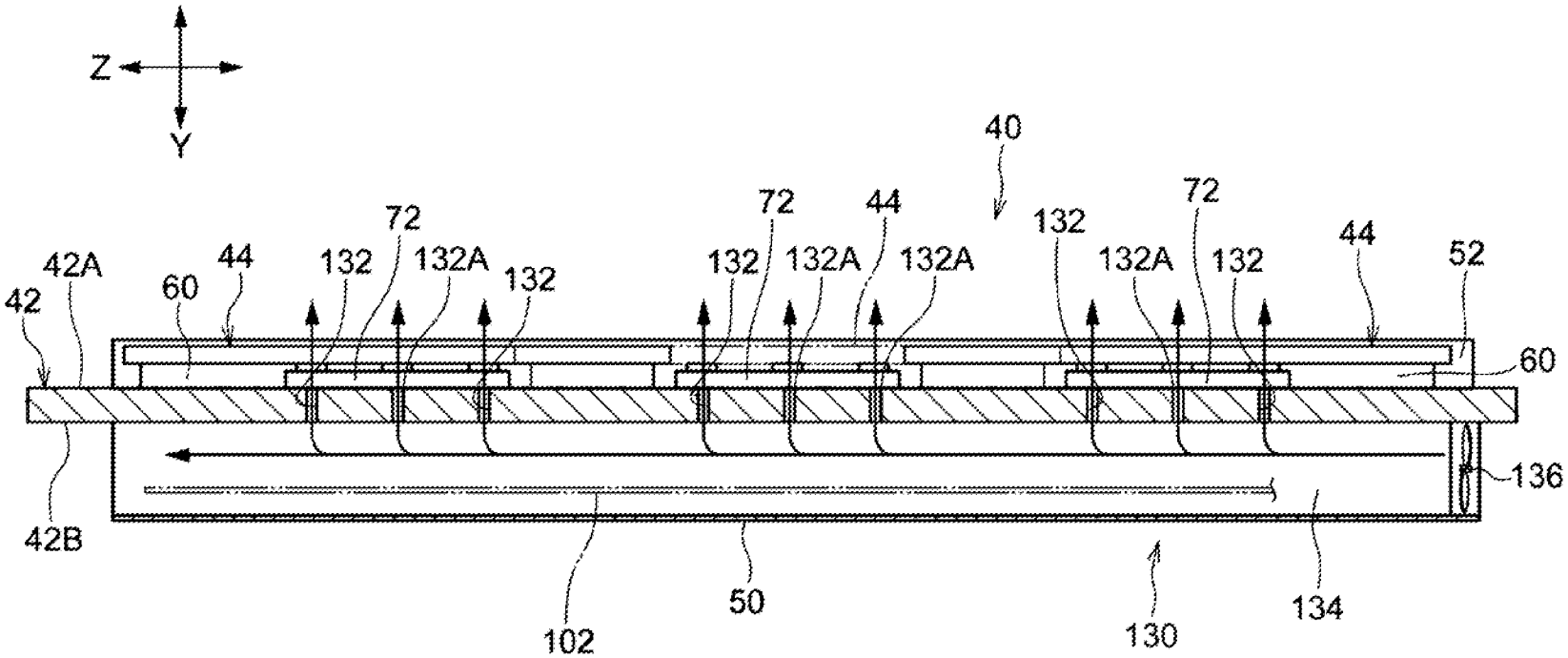
FIG. 8 is a cross-sectional view of an air feeding device of the light exposure device taken in a longitudinal direction of a base plate.

As shown in FIG. 7 and FIG. 8, the light exposure device 40 includes an air feeding device 130, which is disposed in a flow path 134 formed on a side of the base plate 42 opposite to a side facing the light emitting units 44 (that is, formed on a back surface 42B) to allow air to flow through the flow path 134 in the first direction (direction of arrow Z).

Although not illustrated, at both end portions of the base plate 42 in the first direction (direction of arrow Z), positioning shafts extend vertically upward. The positioning shafts are in contact with bearing members at both ends of the corresponding photoconductor drum 32 to fix the position of the light exposure device 40 in the light irradiation direction with respect to the photoconductor drum 32.

Base Plate 42

As illustrated in FIG. 5 to FIG. 8, the base plate 42 is formed from a thin rectangular prism. The base plate 42 is disposed to oppose the photoconductor drum 32 (FIG. 1) throughout in the axial direction.

In an upper surface 42A of the base plate 42 in the vertical direction (direction of arrow Y), recesses 80 that receive the spacers 56 are formed (refer to FIG. 6). For example, the three spacers 56 are arranged for each light emitting unit 44 while being spaced apart from each other in the first direction (direction of arrow Z). In the present exemplary embodiment, three spacers 56 are disposed for each of the three light emitting units 44.

Each recess 80 includes a slope 80A, forming a bottom surface portion and inclined with respect to the surface 42A of the base plate 42, a vertical wall 80B, disposed at the downward end of the slope 80A, and two vertical walls (not illustrated) opposing each other at both sides of the slope 80A (refer to FIG. 5). For example, the slopes 80A for the two light emitting units 44 disposed on the first side of the base plate 42 in the cross direction and the slope 80A for the one light emitting unit 44 disposed on the second side of the base plate 42 in the cross direction are inclined in opposite directions. In the light exposure device 40, the slopes 80A inclined in the opposite directions enable the two light emitting units 44 disposed on the first side of the base plate 42 in the cross direction and the one light emitting unit 44 disposed on the second side of the base plate 42 in the cross direction to emit light toward the center portion of the photoconductor drum 32 (refer to FIG. 1).

In the present exemplary embodiment, the base plate 42 is formed from a metal block. The metal block in the present exemplary embodiment refers to a block of metal excluding typical sheet metal shaped by being bent, and that has a shape usable as a base plate of the light exposure device 40 with a thickness that is substantially unbendable. For example, the thickness of the metal block is 10% or higher of the width of the base plate 42. More specifically, the thickness of the metal block may be 20% or higher and 100% or lower of the width of the base plate 42.

An existing wide image forming apparatus is designed for outputting monochrome images without demanding high image quality unlike a full-color printer for commercial printing, and includes sheet metal for use as the base plate. On the other hand, the image forming apparatus 10 according to the exemplary embodiment is a full-color printer for commercial printing, and is supposed to have high image quality. The image forming apparatus 10 thus includes a metal block that is stiffer than sheet metal to reduce the effect of bending of the base plate 42 on the image quality.

The base plate 42 is formed from, for example, steel or stainless steel. The base plate 42 may be formed from a metal block made of a material other than steel or stainless steel. For example, the base plate 42 may be formed from aluminum that is lighter in weight and more highly thermally conductive than steel or stainless steel. In the present embodiment, heat from light sources 64 is dissipated by support bodies 60. Thus, the base plate 42 is formed from steel or stainless steel while higher priority is given to stiffness over thermal conductivity or weight.

The thickness of the base plate 42 in the vertical direction (direction of arrow Y) is preferably greater than the thickness of the support bodies 60 included in the light emitting units 44. Thus, the base plate 42 has stiffness (flexural rigidity in the direction of arrow Y) greater than the stiffness of the light emitting units 44. The thickness of the base plate 42 in the vertical direction (direction of arrow Y) is preferably equal to or greater than 5 mm, more preferably equal to or greater than 10 mm, and further preferably equal to or greater than 20 mm.

As illustrated in FIG. 6, in a back surface 42B of the base plate 42 opposite to the surface 42A, recessed portions 82 are formed to be set back toward the spacers 56, that is, toward the recesses 80. The recessed portions 82 are formed at positions corresponding to the recesses 80 of the base plate 42. The recessed portions 82 extend obliquely toward the middle portion of the base plate 42 in the cross direction (X direction) from the back surface 42B of the base plate 42. For example, the recessed portions 82 are circular when viewed from the back surface 42B of the base plate 42. The recessed portions 82 have an inner diameter greater than the profile of a head 58A of each fastening member 58. In each of bottom surface portions 82A of the recessed portions 82, a through-hole 84 is formed. A shank 58B of each fastening member 58 extends through the base plate 42 through the through-hole 84. Each through-hole 84 is open in the slope 80A of the corresponding recess 80.

Light Emitting Units 44

As illustrated in FIG. 2 to FIG. 7, the three light emitting units 44 have the same structure, as described above. For example, the two light emitting units 44 on the first side of the base plate 42 in the cross direction (direction of arrow X) and the one light emitting unit 44 on the second side of the base plate 42 in the cross direction (direction of arrow X) are disposed to be symmetrical in the cross direction (direction of arrow X) of the base plate 42.

As illustrated in FIG. 6, the light emitting units 44 each include the support body 60 extending in the first direction (direction of arrow Z), and a light-emitting-device substrate 62 supported on the surface of the support body 60 (vertically upper surface in the present exemplary embodiment) opposite, in the vertical direction (direction of arrow Y), to the surface facing the base plate 42. Multiple light sources 64 are mounted on the light-emitting-device substrate 62 to be arranged in the first direction. In the present exemplary embodiment, each light source 64 includes, for example, multiple light emitting devices. For example, each light source 64 is a light-emitting device array including a semiconductor base plate and multiple light emitting devices arranged over the semiconductor base plate in the first direction. In the present exemplary embodiment, the light-emitting device arrays serving as the light sources 64 are staggered on the light-emitting-device substrate 62 in the first direction. Instead of the light-emitting device array, each light source 64 may be a single light emitting device. Each light emitting device is formed from, for example, a light emitting diode, a light emitting thyristor, or a laser device. The light emitting device has a resolution of, for example, 2400 dpi when arranged in the first direction. The light-emitting-device substrate 62 is a base plate used to allow at least one of the multiple light sources 64 to emit light. FIG. 6 illustrates only one of the light sources 64 of each of the light emitting units 44 without illustrating the other light sources.

Each of the light emitting units 44 includes a pair of mounts 66, disposed on the surface of the light-emitting-device substrate 62 opposite to the surface where the support body 60 is disposed, and the lens unit 68, held while being interposed between upper ends of the pair of mounts 66.

The pair of mounts 66 and the lens unit 68 extend in the first direction (direction of arrow Z) of the support body 60 (refer to FIG. 4 and other drawings). The lens unit 68 is disposed at a position opposing the multiple light sources 64, and the space is left between the lens unit 68 and the multiple light sources 64. In the light exposure device 40, light emitted from the multiple light sources 64 is transmitted through the lens unit 68, and applied to the surface of the photoconductor drum 32 (refer to FIG. 1), serving as an irradiation target.

The support body 60 is formed from a rectangular prism. In the present exemplary embodiment, as in the base plate 42, the support body 60 is formed from a metal block. For example, the support body 60 is formed from steel or stainless steel. Here, the support body 60 may be formed from a metal block made of a material other than steel or stainless steel. For example, the support body 60 may be formed from a metal block made of aluminum that is lighter in weight and more highly thermally conductive than steel or stainless steel. However, when the base plate 42 and the support body 60 have different coefficients of thermal expansion, the base plate 42 and the support body 60 may be deformed or distorted. For prevention of deformation or distortion, the base plate 42 and the support body 60 are preferably formed from the same material.

In the surface of each support body 60 facing the base plate 42, a threaded hole 74 to which the shank 58B of the corresponding fastening member 58 is fastened is formed (refer to FIG. 6). The threaded hole 74 is located to oppose the corresponding through-hole 84 of the base plate 42.

While the fastening members 58 are inserted into the recessed portions 82 of the base plate 42, and the shanks 58B of the fastening members 58 extend through the through-holes 84 of the base plate 42, the shanks 58B of the fastening members 58 are fastened to the threaded holes 74 of the support bodies 60 with the spacers 56 interposed therebetween. Thus, the light emitting units 44 are secured to the base plate 42 with the fastening members 58 at the inner side of the recessed portions 82 of the base plate 42. While the light emitting units 44 are secured to the base plate 42 with the fastening members 58, the spacers 56 are interposed between the base plate 42 and the support bodies 60.

Here, an example conceivable as a method for securing the light emitting units 44 is to use the fastening members 58 extending from the top surfaces (light emerging surfaces) of the support bodies 60 to the top surface of the base plate 42. However, unlike support bodies formed from a resin material or sheet metal, the support bodies 60 according to the present exemplary embodiment are formed from a heavy-mass metal block. This structure has to have fastening members 58 of a size corresponding to the mass of the metal block. This structure would have to have a space for the large-sized fastening members 58 on the top surface of the support bodies 60, involving an increase in size of the support bodies 60. Thus, in the present embodiment, the fastening members 58 are fastened from the back surfaces of the support bodies 60.

The structure where the fastening members 58 are disposed at middle portions, at which the light sources 64 are located, besides both ends of the support bodies 60 prevents the fastening members 58 from being fastened from the top surfaces of the support bodies 60. The structure where the fastening members 58 are fastened from the back surfaces of the support bodies 60 allows the fastening members 58 to be fastened to both ends and the middle portions of the support bodies 60 from only the back surface of the base plate 42.

When viewed in the optical axis direction of each light source 64, the threaded hole 74 and the recessed portion 82 of the base plate 42 are located to overlap the light source 64. Compared to the structure where the threaded hole 74 and the recessed portion 82 are located not to overlap the light source 64, this structure allows heat generated by the light source 64 to be dissipated toward the base plate 42 through the fastening member 58.

As illustrated in FIGS. 6, 7, 9, and 10, a driving substrate 72 is attached to the support body 60 of each light emitting unit 44 with attachments 70. The driving substrate 72 is an example of a substrate. The driving substrate 72 extends in the first direction (direction of arrow Z). The length of the driving substrate 72 in the first direction is smaller than the length of the support body 60 in the first direction (refer to FIG. 9). The driving substrate 72 is a substrate used to drive the corresponding light emitting unit 44, and formed from, for example, an application specific integrated circuit (ASIC) board.

Figure 10:
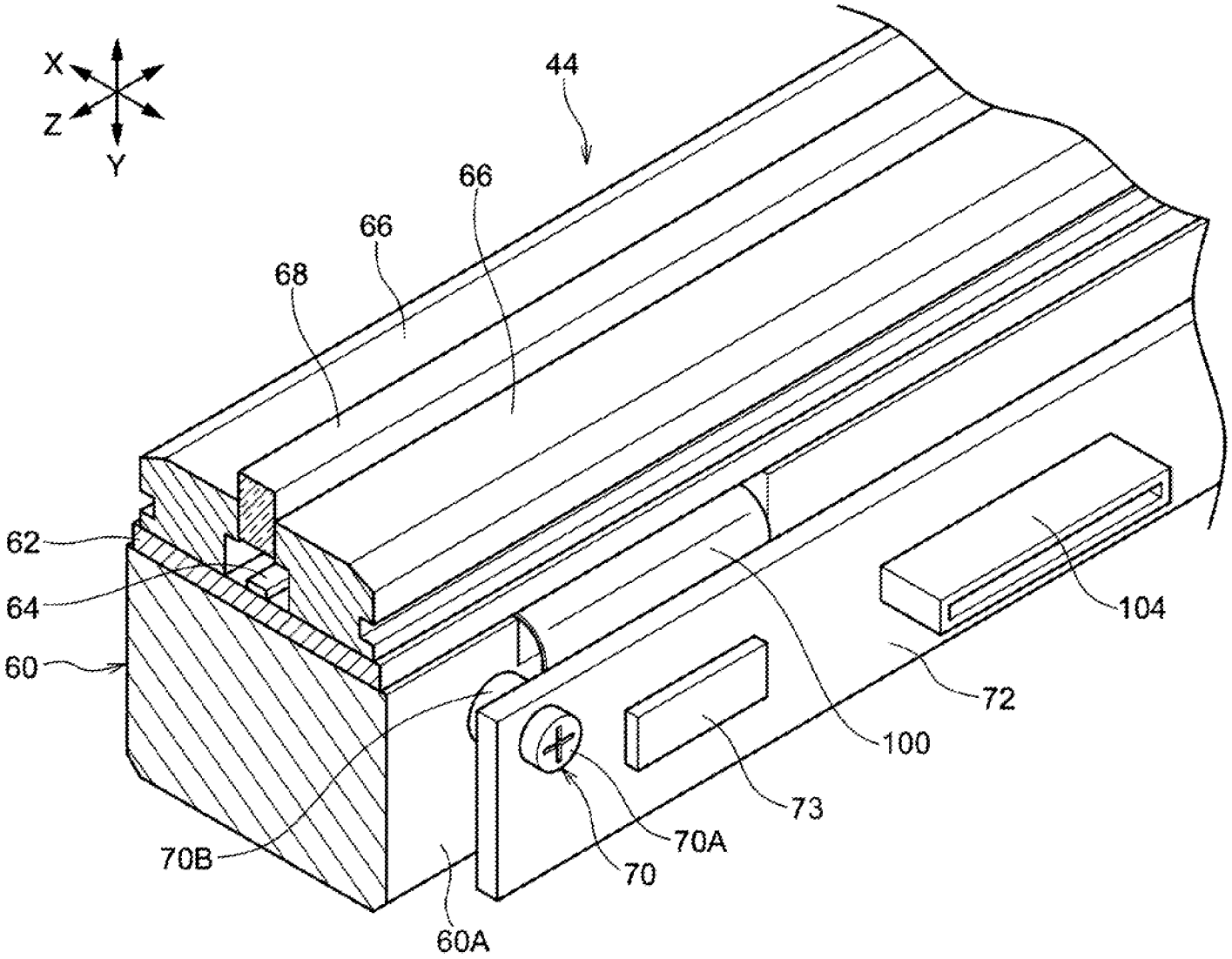
FIG. 10 is a perspective view of part of the light emitting unit taken in the cross direction.

Each attachment 70 includes a fastening bolt 70A, and a shell 70B, disposed between the support body 60 and the driving substrate 72 (refer to FIG. 10). For example, the shell 70B is formed from metal and joined to the driving substrate 72 by, for example, soldering. Although not illustrated, the driving substrate 72 has an opening connected to a through-hole of each shell 70B. The shank of the fastening bolt 70A extends through the shell 70B. When the shank of the fastening bolt 70A extends through the shell 70B from the driving substrate 72 to be fastened to the support body 60, the driving substrate 72 is attached to the support body 60. The driving substrate 72 is attached to the support body 60 with the two attachments 70 disposed at both end portions of the driving substrate 72 in the first direction.

The surface (specifically, a flat surface) of the driving substrate 72 extends along a crosswise inner side portion 60A of the support body 60, that is on the inner side in the cross direction (direction of arrow X) of the base plate 42 (refer to FIG. 7). Here, the inner side portion 60A of the support body 60 refers to as a portion closer to the middle portion of the base plate 42 in the cross direction.

The shell 70B of each attachment 70 forms a gap between the inner side portion 60A of the support body 60 and the surface (flat surface) of the driving substrate 72. Specifically, the driving substrate 72 is attached to the support body 60 of the light emitting unit 44 by the attachments 70 without directly coming into contact with the inner side portion 60A of the support body 60.

The inner side portion 60A of the support body 60 is a slope inclined inward with respect to the surface 42A of the base plate 42. As in the case of the inner side portion 60A, the flat surface of the driving substrate 72 is also inclined inward with respect to the surface 42A of the base plate 42.

Each of the three light emitting units 44 includes the driving substrate 72 on the inner side portion 60A of the corresponding support body 60.

As illustrated in FIG. 3 and FIG. 4, in a side view, the driving substrate 72 disposed on one of the light emitting units 44 is disposed not to overlap the other light emitting unit adjacent to the one light emitting unit 44. The driving substrates 72 disposed on the three light emitting units 44 on the base plate 42 have the same length in the first direction (direction of arrow Z), and is shorter than the portion of the light emitting unit 44 disposed at the middle in the first direction that does not overlap the light emitting units 44 on both sides in the first direction.

Figure 9:
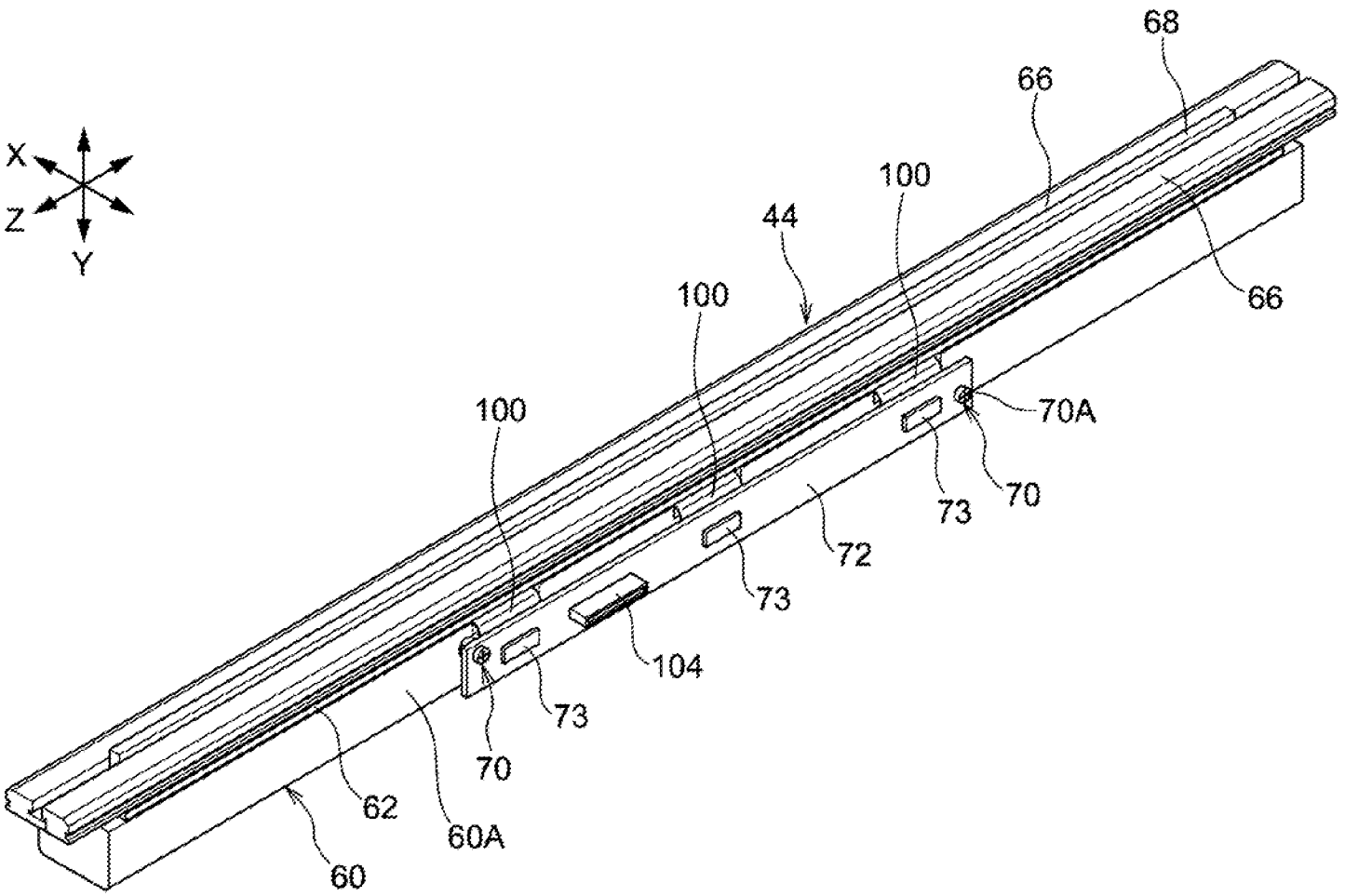
FIG. 9 is a perspective view of the light emitting unit of the light exposure device.

As illustrated in FIGS. 7, 9, and 10, three flexible cables 100 are connected to each light-emitting-device substrate 62 above the support body 60. The three flexible cables 100 extend outward from the support bodies 60 from above the inner side portion 60A of the support body 60. The three flexible cables 100 extending outward from the support body 60 are electrically connected to the three driving elements 73 on the driving substrate 72. Examples of the driving elements 73 include integrated circuits.

At a middle portion of the driving substrate 72 in the first direction (direction of arrow Z), a connector 104 to which a flat cable 102 is electrically connected from outside of the light emitting unit 44 is disposed. A connection port of the connector 104 is formed in the direction crossing the surface (flat surface) of the driving substrate 72. A connection portion of the flat cable 102 is insertable into and removable from the connector 104 in the direction crossing the surface (flat surface) of the driving substrate 72. The flat cable 102 is an example of a wire.

As illustrated in FIG. 7, the flat cable 102 connected to the connector 104 extends from the driving substrate 72 in a direction away from the support body 60. The base plate 42 has through portions 106, which extend through in the vertical direction (direction of arrow Y), at positions corresponding to the positions where the flat cables 102 are connected to the driving substrates 72. Each through portion 106 is formed in the base plate 42 at a position on the side of the corresponding driving substrate 72 in the cross direction (direction of arrow X) of the base plate 42, and on the side opposite to the side on which the light emitting unit 44 including the driving substrate 72 is disposed (that is, on the side having no light emitting unit 44). Each flat cable 102 extends through the corresponding through portion 106 of the base plate 42 to be wired onto the back surface 42B of the base plate 42 inside the lower covering 50. In other words, the flat cable 102 is disposed inside the lower covering 50.

As illustrated in FIG. 4 and FIG. 5, each flat cable 102 is connected via the connector 104 to the driving substrate 72 on each of the three light emitting units 44. The base plate 42 has through portions 106 on the sides of the driving substrates 72 on the three light emitting units 44. The flat cables 102 for each of the three light emitting units 44 extend through the through portions 106 in the base plate 42 to extend inside the lower covering 50 on the back surface 42B of the base plate 42 (refer to FIG. 7).

For example, each light emitting unit 44 is longer in the height direction than in the width direction perpendicular to the first direction (direction of arrow Z). Specifically, the light emitting unit 44 is longer in the vertical direction (direction of arrow Y) than in the cross direction (direction of arrow X). Thus, the center of gravity of the light emitting unit 44 is higher than in a structure where a light emitting unit is shorter in the vertical direction than in the width direction perpendicular to the first direction.

Spacers 56

As illustrated in FIG. 6, the spacers 56 are interposed between the base plate 42 and the light emitting units 44 in an optical axial direction of the light sources 64. For example, each spacer 56 has a plate shape and is formed from a single component. In the present exemplary embodiment, each spacer 56 has a U shape when viewed in the optical axial direction of the light source 64. Each spacer 56 includes a body 56A and a depression 56B, cut out from one side of the body 56A.

Each spacer 56 is disposed on the slope 80A of the corresponding recess 80 of the base plate 42. When the spacer 56 is disposed on the slope 80A, the spacer 56 has a thickness equal to or greater than the depth of the recess 80. The fastening members 58 secure the light emitting units 44 to the base plate 42 while allowing the spacers 56 to bear compression load.

Brackets 48

As illustrated in FIG. 7, brackets 48 have a function of holding the flat cables 102. Here, the brackets 48 are examples of a holding member. More specifically, each of the brackets 48 includes a U-shaped support portion 48A, which protrudes from the back surface 42B of the base plate 42 to the side opposite to the side facing the light emitting unit 44, and a pair of attachments 48B bent inward from the upper end portion of the support portion 48A (bent inward in the cross direction of the base plate 42). The support portion 48A includes, at a lower middle portion of the U shape, a flat portion 49 that faces the back surface 42B of the base plate 42. A portion of the support portion 48A away from the flat portion 49 is open to the base plate 42. The pair of attachments 48B are attached to the base plate 42 with fastening members 110 while being in surface contact with the back surface 42B of the base plate 42.

The multiple brackets 48 are arranged at intervals in the first direction (direction of arrow Z) of the base plate 42 (refer to FIG. 5). The flat cable 102 are held on the flat portion 49 of the support portion 48A. The flat cables 102 supported by the multiple brackets 48 extend in the first direction (direction of arrow Z) of the base plate 42 inside the lower covering 50.

Lower Covering 50

As illustrated in FIG. 4 and FIG. 7, the lower covering 50 covers the harnesses 46 and the flat cables 102 electrically connected to the three light emitting units 44. The lower covering 50 is attached to the vertically lower side of the base plate 42 (that is, the back surface 42B of the base plate 42 illustrated in FIG. 5) to protrude from the base plate 42 to the side away from the light emitting unit 44 and to cover part of the back surface 42B of the base plate 42. In the present exemplary embodiment, the lower covering 50 has a U-shaped cross section. The upper end portion of the lower covering 50 is attached to both sides of the base plate 42 in the cross direction (direction of arrow X) with multiple fastening members 86. The lower covering 50 is attachable to or removable from the base plate 42 by fastening or unfastening the fastening members 86.

When placed on a flat surface at its bottom surface, the lower covering 50 raises the position of the base plate 42. When located at a higher level, the base plate 42, formed from a metal block, raises the center of gravity of the light exposure device 40.

Side Coverings 52

As illustrated in FIGS. 2, 6, and 7, the side coverings 52 are disposed on both end portions of the base plate 42 in the cross direction (direction of arrow X). The side coverings 52 are disposed to extend on the sides of the three light emitting units 44 in the first direction (direction of arrow Z). Thus, the side coverings 52 have a function of protecting the three light emitting units 44 from the outside.

When viewed from the side of the light exposure device 40 (when viewed in the direction of arrow X), the side coverings 52 are located to overlap the three light emitting units 44. The length of the side coverings 52 in the first direction (direction of arrow Z) is greater than the length of the area of the base plate 42 over which the three light emitting units 44 are disposed (refer to FIGS. 2 and 3).

As illustrated in FIG. 7, a support portion 122, which supports each side covering 52, is disposed inward from the side covering 52. Mounts 120 are disposed on the surface 42A of the base plate 42 at end portions in the cross direction (direction of arrow X). Each support portion 122 is supported at the corresponding mount 120. Each support portion 122 supports the corresponding side covering 52 while being in contact with the side covering 52 to prevent the side covering 52 from leaning toward the light emitting unit 44. The support portions 122 are respectively disposed for the side coverings 52 on both sides of the base plate 42 in the cross direction. Although not illustrated, the multiple support portions 122 are disposed at intervals in the first direction (direction of arrow Z) of the side coverings 52.

Air Feeding Device 130

As illustrated in FIG. 7 and FIG. 8, the air feeding device 130 includes a flow path 134, which allows air to flow therethrough, inside the lower covering 50 attached to an end portion of the back surface 42B of the base plate 42. The air feeding device 130 includes a fan 136, disposed at an end portion of the lower covering 50 in the first direction (direction of arrow Z). The air feeding device 130 also includes feed ports 132, which feed air from the flow path 134 toward the surface 42A of the base plate 42. Here, the air feeding device 130 is an example of an air blower that blows air from the surface 42A of the base plate 42 toward the light emitting units 44.

As described above, the lower covering 50 has a U-shaped cross section taken in the cross direction of the base plate 42, and the upper end portions of the lower covering 50 are attached to the side surfaces of the base plate 42 with the fastening members 86. The lower covering 50 covers the back surface 42B of the base plate 42, and extends in the first direction (direction of arrow Z) of the base plate 42. The flow path 134 inside the lower covering 50 extends in the first direction (direction of Z) of the base plate 42, and air is fed to the multiple feed ports 132 of the base plate 42 from the flow path 134.

As illustrated in FIG. 7 and FIG. 8, inside the lower covering 50, the flat cables 102 connected to the respective light emitting units 44 extend in the first direction (direction of arrow Z) of the base plate 42. The lower covering 50 also serves as a covering for the flat cables 102.

The fan 136 introduces air into the flow path 134 inside the lower covering 50 with rotation. Rotation of the fan 136 feeds air in the first direction (direction of arrow Z) of the flow path 134. Thus, air flows through the flow path 134 from the end where the fan 136 is disposed to the end opposite to the end where the fan 136 is disposed.

For example, the feed ports 132 extend through the base plate 42 in the vertical direction (direction of arrow Y). Openings 132A in the surface 42A of the base plate 42 are formed at the upper ends of the feed ports 132. For example, the light emitting units 44 are disposed on the upper side of the base plate 42 in the vertical direction (direction of arrow Y), and the feed ports 132 flow air upward from below the base plate 42. Specifically, the feed ports 132 feed air from the back surface 42B of the base plate 42 toward the surface 42A on which the light emitting units 44 are disposed. In the present exemplary embodiment, the feed ports 132 are disposed at a middle portion of the base plate 42 in the width direction, that is, the cross direction (direction of arrow X). Here, the middle portion of the base plate 42 in the width direction corresponds to an area extending from the point ⅓ of the width away from an edge of the base plate 42 to the point ⅔ of the width away from the edge.

The multiple feed ports 132 are arranged in the first direction (direction of arrow Z) of the light emitting unit 44. In the present exemplary embodiment, three feed ports 132 are arranged at intervals in the first direction (direction of arrow Z) for each light emitting unit 44.

The feed ports 132 are formed at, for example, positions corresponding to the driving substrates 72 attached to the inner side portions 60A of the support bodies 60 on the light emitting units 44. Specifically, the openings 132A of the feed ports 132 are located below the driving substrate 72 in the vertical direction (direction of arrow Y) (refer to FIG. 7). For example, the feed ports 132 and the openings 132A are long holes extending in the first direction of the base plate 42.

For example, the openings 132A of the three feed ports 132 oppose the three driving elements 73 in the driving substrate 72. Specifically, the openings 132A of the three feed ports 132 are formed below the three driving elements 73 in the driving substrate 72 in the vertical direction (direction of arrow Y) (refer to FIG. 4 and FIG. 5). Thus, air is blown from the openings 132A of the feed ports 132 toward the driving elements 73 on the driving substrate 72.

Among the three light emitting units 44, the light emitting units 44 on both end portions of the base plate 42 in the first direction (direction of arrow Z) and the light emitting unit 44 at the middle portion of the base plate 42 in the first direction (direction of arrow Z) are arranged while being shifted in the width direction crossing the first direction (direction of arrow Z) of the base plate 42. Specifically, as described above, the three light emitting units 44 are staggered on the base plate 42 when viewed in a plan. The openings 132A of the feed ports 132 are formed on the inner side of the respective light emitting units 44 in the cross direction (width direction) of the base plate 42 (refer to FIG. 3).

In the present exemplary embodiment, the inner side portions 60A of the support bodies 60 of the light emitting units 44 are inclined inward with respect to the surface 42A of the base plate 42. The driving substrates 72, disposed along the inner side portions 60A, are inclined inward with respect to the surface 42A of the base plate 42. Thus, air is blown from the openings 132A of the feed ports 132 toward the driving substrates 72 inclined inward with respect to the surface 42A of the base plate 42.

As illustrated in FIG. 7, the flat cables 102 electrically connected to the three light emitting units 44 are wired into the flow path 134 through the through portions 106 of the base plate 42, as described above. The flat cables 102 are supported by the multiple brackets 48 inside the flow path 134 to extend through the flow path 134 in the first direction (direction of arrow Z). In other words, the flat cables 102 are disposed in the flow path 134 in the first direction (direction of arrow Z). The flat cables 102 are disposed in the flow path 134 with the multiple brackets 48 at the end of the flow path 134 away from the base plate 42 (at the vertically lower portion in the present exemplary embodiment). Here, the end inside the flow path 134 away from the base plate 42 refers to the position closer to the end (that is, lower portion) with respect to the half point in the height direction of the flow path 134 inside the lower covering 50.

The flat cables 102 supported by the brackets 48 and the back surface 42B of the base plate 42 are spaced apart from each other. Specifically, the flat cables 102 and the back surface 42B of the base plate 42 are distant from each other so that the flat cables 102 and the feed ports 132 of the base plate 42, which will be described later, do not interfere with each other.

As illustrated in FIG. 8, the air feeding device 130 introduces air into the flow path 134 inside the lower covering 50 with rotation of the fan 136. Air flows through the flow path 134 inside the lower covering 50 in the first direction (direction of arrow Z) toward the end opposite to the end where the fan 136 is disposed. When air flows in the first direction (direction of arrow Z) of the base plate 42, air is fed to the multiple feed ports 132 of the base plate 42. Then, air is blown toward the driving substrates 72 on the light emitting units 44 from the openings 132A of the feed ports 132.

Cleaning Device 54

As illustrated in FIG. 7, each cleaning device 54 includes a belt-shaped cleaner unit 126, which cleans an upper surface 68A of the lens unit 68 (refer to FIG. 2). The cleaner unit 126 is disposed in the direction crossing the lens unit 68. The cleaning device 54 includes a shaft 128, which is coupled to the cleaner unit 126 with a coupling member not illustrated to move the cleaner unit 126 in the first direction (direction of arrow Z) of the lens unit 68. At least one of the multiple support portions 122 has a hole 123, through which the shaft 128 extends. The support portion 122 serves as a guide portion that guides the shaft 128.

The shaft 128, the support portion 122, and the mount 120 are disposed on the side of the light emitting unit 44 opposite to the side where the opening 132A is formed.

Operations and Effects

The operations and effects of the present exemplary embodiment will be described.

The light exposure device 40 includes the base plate 42 formed from a metal block extending in the first direction (direction of arrow Z), and the three light emitting units 44 each including the support body 60 extending in the first direction and the multiple light sources 64 (refer to FIG. 6) arranged in the first direction and supported by the support body 60.

In the light exposure device 40, the base plate 42 extends throughout in the axial direction of the photoconductor drum 32. The three light emitting units 44 are arranged while being shifted from each other in the first direction of the base plate 42. At least one of the three light emitting units 44 opposes an area of the photoconductor drum 32 over which the photoconductor is disposed in the axial direction. The light exposure device 40 applies light from the light emitting units 44 to the photoconductor drum 32 to form an electrostatic latent image over the area of the photoconductor drum 32 where the photoconductor is disposed.

In the light exposure device 40, the three light emitting units 44 are arranged over the base plate 42 while being shifted from each other in the first direction (direction of arrow Z). The length of the base plate 42 in the first direction (direction of arrow Z) is greater than the length of each of the light emitting units 44 in the first direction (direction of arrow Z).

As described above, in the structure where multiple light emitting units are disposed on a base plate while being shifted from each other in the first direction, the driving substrates respectively disposed on the multiple light emitting units generate more heat, and may degrade image quality due to thermal expansion of each component.

In the light exposure device 40 according to the present exemplary embodiment, the flow path 134 is disposed inside the lower covering 50, which covers the side (that is, the back surface 42B) of the base plate 42 opposite to the side where the light emitting units 44 are disposed. Rotation of the fan 136 introduces air into the flow path 134 in the first direction (direction of arrow Z). Air thus fed cools the base plate 42, and heat of the light emitting units 44 is transferred to the base plate 42. Compared to the structure that does not allow air to flow in the first direction of the base plate 42, the light exposure device 40 reduces degradation of image quality due to expansion of each component with heat of the light emitting units 44.

In the above light exposure device 40, the lower covering 50 is disposed on the side of the base plate 42 opposite to the side where the three light emitting units 44 are disposed. When the lower covering 50 is placed on a flat surface, the center of gravity of the light exposure device 40 is raised, and the light exposure device 40 is more likely to fall sideways.

In the light exposure device 40 according to the present exemplary embodiment, the flat cables 102 electrically connected to the respective three light emitting units 44 are disposed inside the flow path 134. Compared to a structure including wires disposed outward from the base plate in the width direction, the light exposure device 40 reduces damages on the flat cables 102 caused when the light exposure device 40 falls sideways.

In the light exposure device 40, the flat cables 102 are disposed inside the flow path 134 in the first direction (direction of arrow Z). Thus, compared to a structure including wires disposed in the flow path in the direction crossing the first direction, the light exposure device 40 has simpler wiring of the flat cables 102.

The light exposure device 40 includes the brackets 48 that hold the flat cables 102 inside the flow path 134, and the brackets 48 are disposed on the base plate 42. Compared to a structure where the lower covering that forms a flow path inside has a holding member, the light exposure device 40 facilitates attachment and removal of the lower covering 50.

The light exposure device 40 includes the air feeding device 130, which blows air fed from the flow path 134 from the surface 42A of the base plate 42 toward the light emitting unit 44. Thus, compared to a structure that includes a feeder that feeds air toward the light emitting units besides the flow path, the light exposure device 40 has a simpler mechanism of blowing air toward the light emitting units.

In the light exposure device 40, the air feeding device 130 includes the feed ports 132 formed in the base plate 42 and through which air is fed from the flow path 134 toward the light emitting units 44. Compared to a structure where pipes for feeding air from the flow path are attached to the base plate, the light exposure device 40 has a simpler mechanism of blowing air from the flow path 134 toward the light emitting unit.

In the light exposure device 40, the feed ports 132 extend from the back surface 42B of the base plate 42 to the surface 42A on which the light emitting units 44 are disposed. Thus, compared to a structure where pipes for feeding air from the flow path are attached to the outer side of the base plate, the light exposure device 40 has a simpler mechanism of blowing air from the flow path 134 toward the light emitting units 44.

In the light exposure device 40, the flat cables 102 are disposed at the end of the flow path 134 away from the base plate 42. Thus, compared to a structure including wires disposed beside the base plate, the light exposure device 40 prevents the flat cables 102 from clogging the feed ports 132.

In the light exposure device 40, the base plate 42 is formed from a metal block. Compared to the structure where the base plate is formed from sheet metal, the light exposure device 40 improves heat dissipation from the three light emitting units 44.

In the light exposure device 40, the support bodies 60 of the light emitting units 44 are formed from metal blocks. Compared to the structure where the support bodies are formed from resin, the light exposure device 40 improves heat dissipation from the three light emitting units 44.

In the light exposure device 40, each light-emitting-device substrate 62 is disposed on the surface of the corresponding support body 60 opposite to the surface facing the base plate 42. Compared to the structure where the support body is formed from resin, the light exposure device 40 improves heat dissipation from the three light emitting units 44.

The image forming apparatus 10 includes the light exposure device 40 and the photoconductor drum 32, which moves relative to the light exposure device 40 in the direction crossing the first direction (Z direction) and is irradiated with light from the light exposure device 40. The surface of the photoconductor drum 32 has an area over which a photosensitive material is disposed. Thus, compared to the structure including wires disposed outward from the base plate of the light emitting unit in the width direction, the image forming apparatus 10 reduces damages on the flat cables 102 caused when the light exposure device 40 falls sideways during operation. Examples of the operation include manufacture and maintenance.

In the image forming apparatus 10, the area over which the photosensitive material is disposed is located on the surface of the photoconductor drum 32, which is a cylindrical member rotating in the circumferential direction. The image forming apparatus 10 including the photoconductor drum 32 reduces damages on the flat cables 102 caused when the light exposure device 40 falls sideways during operation, compared to the structure including wires disposed outward from the base plate in the width direction.

Second Exemplary Embodiment

A light exposure device according to a second exemplary embodiment will now be described. In the second exemplary embodiment, components or portions the same as those of the first exemplary embodiment are denoted with the same reference signs without detailed description, and different points will be described.

Figure 11:
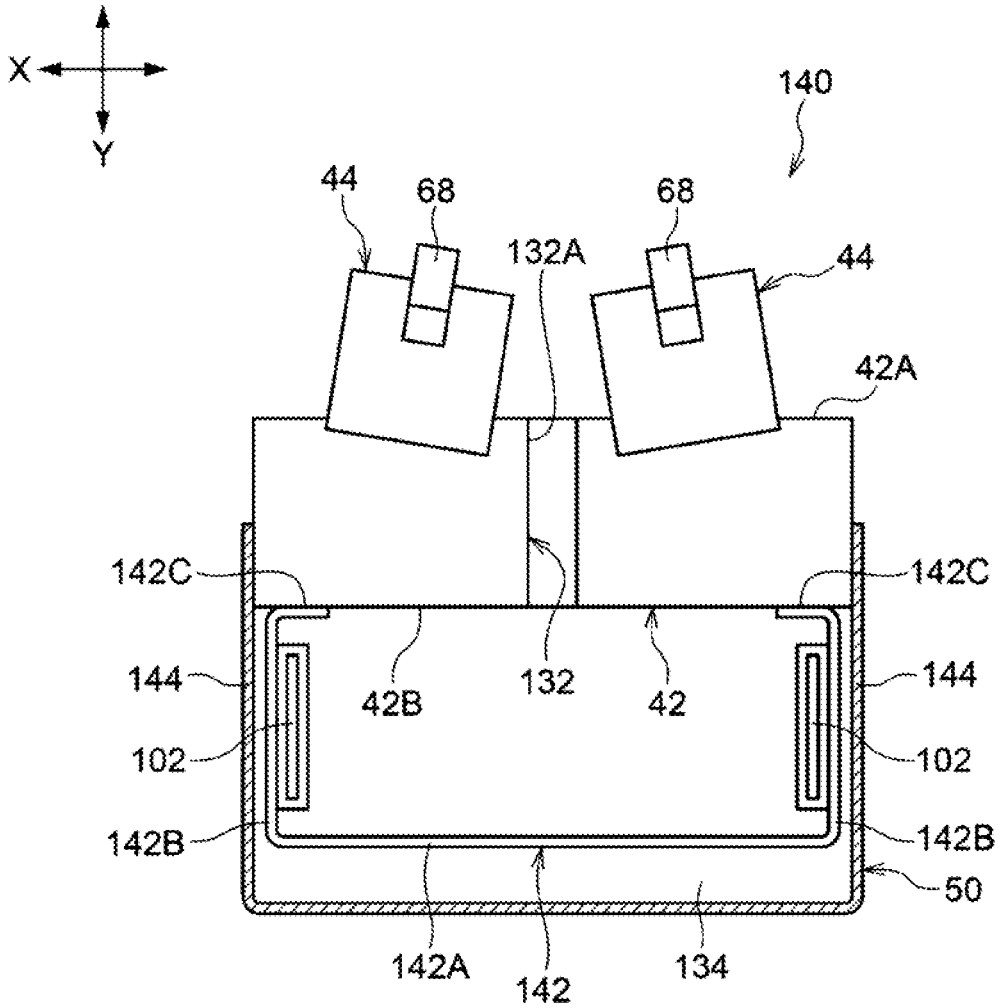
FIG. 11 is a cross-sectional view of a light exposure device according to a second exemplary embodiment taken in the cross direction of the base plate.

FIG. 11 illustrates a light exposure device 140 according to a second exemplary embodiment. As illustrated in FIG. 11, the light exposure device 140 includes a bracket 142 that holds the flat cables 102. The light exposure device 140 has the same components as the light exposure device 40 according to the first exemplary embodiment except for the bracket 142. FIG. 11 is a schematic diagram of the light exposure device 140 for clarifying the structure of the light exposure device 140.

The bracket 142 is, for example, a belt-shaped member disposed in the direction crossing the first direction of the base plate 42. The bracket 142 is an example of a holding member. The bracket 142 includes a bottom surface portion 142A, which is a horizontal surface, a pair of vertical walls 142B, bent upward from both end portions of the bottom surface portion 142A, and a pair of attachments 142C, bent inward in the width direction of the base plate 42 from the upper end portions of the vertical walls 142B. The pair of attachments 142C are secured to the base plate 42 with fastening members (not illustrated) while being in surface contact with the back surface 42B of the base plate 42.

The feed ports 132 are formed at a middle portion in the width direction of the base plate 42, that is, in the cross direction (direction of arrow X). The pair of vertical walls 142B are disposed on both sides of the feed ports 132 in the width direction of the base plate 42, beside side surfaces 144, on both sides in the width direction, of the lower covering 50 inside the flow path 134. In the present exemplary embodiment, one of the pair of vertical walls 142B disposed on a first side in the width direction of the base plate 42 holds the flat cable 102 electrically connected to the light emitting unit 44 disposed on the first side in the width direction of the base plate 42. The other vertical wall 142B disposed on a second side in the width direction of the base plate 42 holds the flat cable 102 electrically connected to the light emitting unit 44 disposed on the second side in the width direction of the base plate 42. The flat cables 102 are vertically disposed beside the side surfaces 144 in the width direction of the lower covering 50 inside the flow path 134. Here, vertically disposed refers to disposing the surface of the flat cable 102 in the vertical direction (direction of arrow Y).

The light exposure device 140 has the following operations and effects besides the similar operations and effects of that of the light exposure device 40 according to the first exemplary embodiment.

In the light exposure device 140, the flat cables 102 are disposed closer to the side surfaces 144 in the width direction of the lower covering 50 inside the flow path 134. Thus, compared to the structure including wires disposed at a middle portion in the width direction of the base plate, the light exposure device 140 prevents the flat cables 102 from clogging the feed ports 132.

In the light exposure device 140, the flat cables 102 are vertically disposed inside the flow path 134. Thus, compared to a structure including wires disposed horizontally inside the flow path, the light exposure device 140 prevents the flat cables 102 from clogging the feed ports 132.

Third Exemplary Embodiment

A light exposure device according to a third exemplary embodiment will now be described. In the third exemplary embodiment, components or portions the same as those of the first and second exemplary embodiments are denoted with the same reference signs without detailed description, and only different components will be described.

Figure 12:
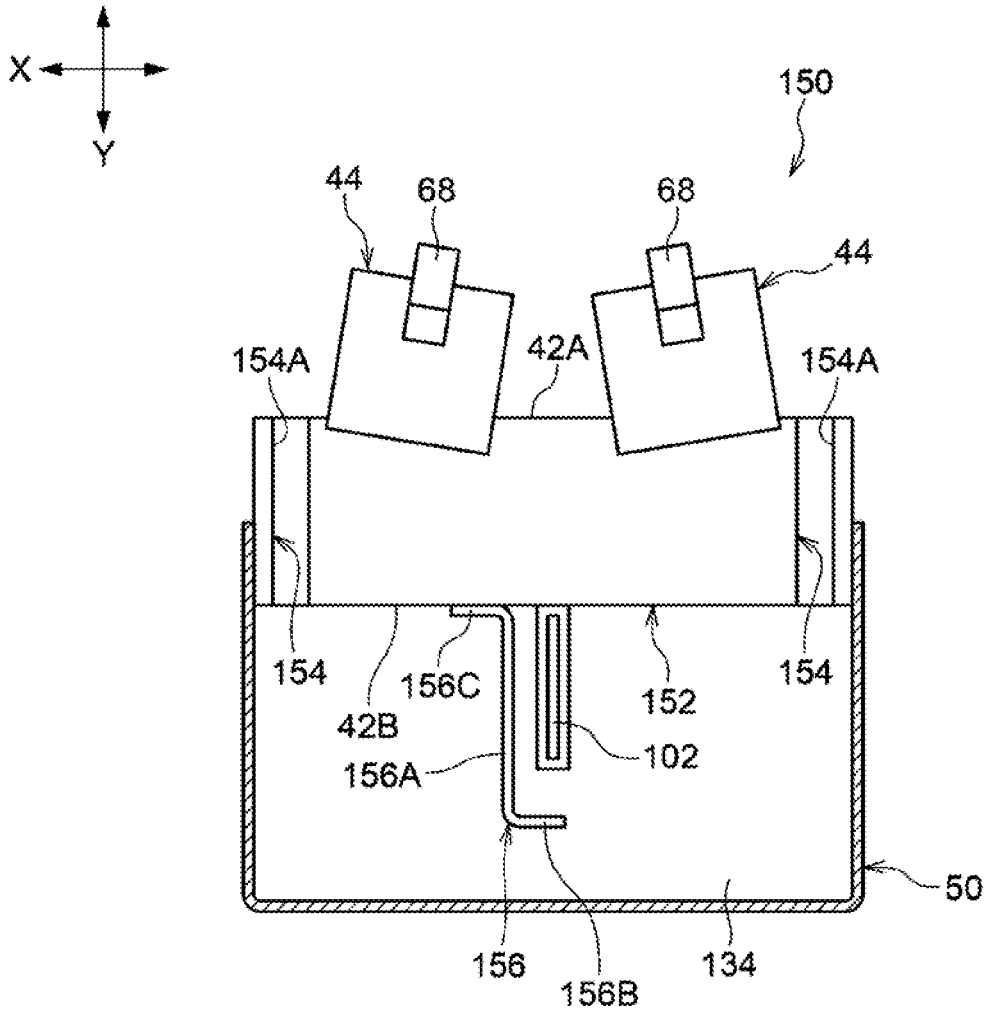
FIG. 12 is a cross-sectional view of a light exposure device according to a third exemplary embodiment taken in the cross direction of the base plate.

FIG. 12 illustrates a light exposure device 150 according to a third exemplary embodiment. As illustrated in FIG. 12, the light exposure device 150 includes a base plate 152, feed ports 154 formed in the base plate 152, and brackets 156 that holds the flat cables 102. The light exposure device 150 has the same components as the light exposure devices according to the first and second exemplary embodiments except for the feed ports 154 in the base plate 152 and the brackets 156. FIG. 12 is a schematic diagram of the light exposure device 150 for clarifying the structure of the light exposure device 150.

The base plate 152 is formed from a rectangular parallelepiped metal block. The feed ports 154 extend through the base plate 152 from the back surface 42B of the base plate 152 to the surface 42A of the base plate 152 in the vertical direction (direction of arrow Y) of the base plate 152. Each feed port 154 has, at the upper end, an opening 154A that is open in the surface 42A of the base plate 152. The feed ports 154 are formed at both end portions of the base plate 152 in the width direction, that is, in the cross direction (direction of arrow X). Here, both end portions in the width direction of the base plate 152 refer to areas extending from the edges in the width direction of the base plate 42 to the points ⅓ of the width away from the edges.

Each bracket 156 is formed from, for example, a belt-shaped member extending in the direction crossing the first direction of the base plate 152. The bracket 156 is an example of a holding member. The bracket 156 includes a vertical wall 156A extending in the vertical direction, and a bent portion 156B, bent from the lower end of the vertical wall 156A toward the first side in the width direction of the base plate 152. The bracket 156 also includes a mount 156C, bent from the upper end portion of the vertical wall 156A toward the second side in the width direction of the base plate 152, that is, bent in the direction opposite to the direction in which the bent portion 156B is bent. The mount 156C is secured to the base plate 152 with fastening members (not illustrated) while being in surface contact with the back surface 42B of the base plate 152. The bracket 156 is disposed between the feed ports 154 at both end portions in the width direction of the base plate 152.

The vertical walls 156A of the brackets 156 hold the flat cables 102 electrically connected to the multiple light emitting units 44 on the base plate 152. The flat cables 102 are vertically disposed inside the flow path 134. In the present exemplary embodiment, the flat cables 102 are disposed by the brackets 156 between the feed ports 154 on both end portions in the width direction of the base plate 152.

The light exposure device 150 has the following operations and effects besides the similar operations and effects of the light exposure device 40 according to the first exemplary embodiment.

In the light exposure device 150, the flat cables 102 are vertically disposed inside the flow path 134. Thus, compared to a structure including wires horizontally disposed inside the flow path, the light exposure device 150 prevents the flat cables 102 from clogging the feed ports 154.

Fourth Exemplary Embodiment

Subsequently, a light exposure device according to a fourth exemplary embodiment will be described. In the fourth exemplary embodiment, components or portions the same as those of the first to third exemplary embodiments are denoted with the same reference signs without detailed description, and only different components will be described.

Figure 13:
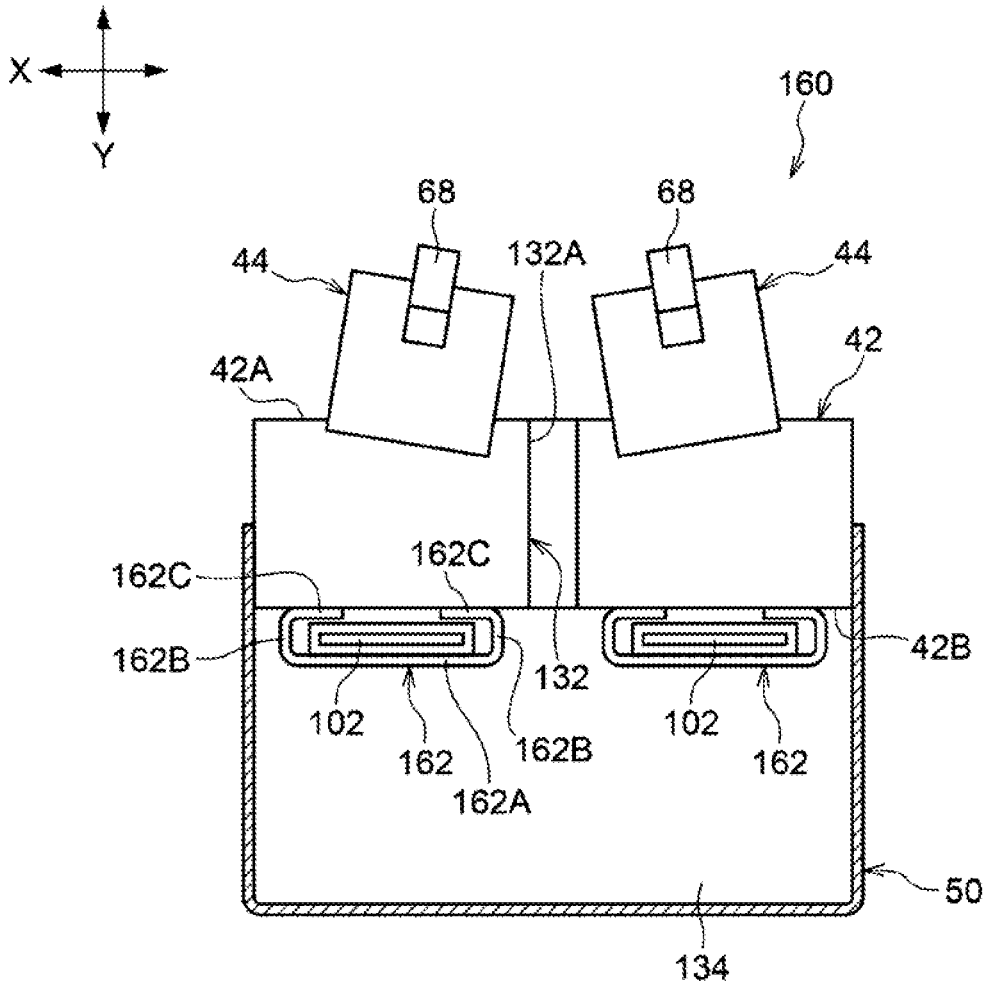
FIG. 13 is a cross-sectional view of a light exposure device according to a fourth exemplary embodiment taken in the cross direction of the base plate.

FIG. 13 illustrates a light exposure device 160 according to a fourth exemplary embodiment. As illustrated in FIG. 13, the light exposure device 160 includes brackets 162 that hold the flat cables 102. The light exposure device 160 has the same components as the light exposure devices according to the first to third exemplary embodiments except for the brackets 162. FIG. 13 is a schematic diagram of the light exposure device 160 for clarifying the structure of the light exposure device 160.

The feed ports 132 are formed at a middle portion in the width direction of the base plate 42, that is, the cross direction (direction of arrow X). The brackets 162 are disposed on both sides of the feed ports 132 in the width direction of the base plate 42. The brackets 162 are symmetric with each other in the width direction of the base plate 42. The brackets 162 are examples of a holding member.

The brackets 162 are formed from, for example, belt-shaped members that cross the first direction of the base plate 42. Each of the brackets 162 includes a bottom surface portion 162A, which is a horizontal surface, a pair of vertical walls 162B, bent upward from both end portions of the bottom surface portion 162A, and a pair of attachments 162C, bent from the upper end portions of the vertical walls 162B inward in the width direction of the base plate 42. The pair of attachments 162C are secured to the base plate 42 with fastening members (not illustrated) while being in surface contact with the back surface 42B of the base plate 42.

The vertical walls 162B are shorter than the bottom surface portion 162A. The bottom surface portion 162A extends along the back surface 42B of the base plate 42 while being spaced apart from the back surface 42B of the base plate 42. In the present exemplary embodiment, the bottom surface portion 162A of each bracket 162 disposed on the first side in the width direction of the base plate 42 holds the flat cable 102 electrically connected to the light emitting unit 44 disposed on the first side in the width direction of the base plate 42. The bottom surface portion 162A of the bracket 162 disposed on the second side in the width direction of the base plate 42 holds the flat cable 102 electrically connected to the light emitting unit 44 disposed on the second side in the width direction of the base plate 42. The flat cables 102 are disposed along the base plate 42 beside the base plate 42 inside the flow path 134. Specifically, the flat cables 102 are horizontally disposed inside the flow path 134. The flat cables 102 are disposed outward from the feed ports 132 of the base plate 42 in the width direction.

The light exposure device 160 has the following operations and effects besides the similar operations and effects of the light exposure device 40 according to the first exemplary embodiment.

In the light exposure device 160, the flat cables 102 are disposed along the base plate 42 beside the base plate 42 inside the flow path 134. Thus, compared to a structure including wires disposed outward from the base plate in the width direction, the light exposure device 160 including the flat cables 102 disposed beside the base plate 42 inside the flow path 134 facilitates attachment and removal of the lower covering 50.

In the light exposure device 160, the feed ports 132 are formed at a middle portion in the width direction of the base plate 42, and the flat cables 102 are disposed along the base plate 42 beside the base plate 42 inside the flow path 134 outward from the feed ports 132 in the width direction. Thus, compared to a structure where wires and feed ports overlap, the light exposure device 160 prevents the flat cables 102 from clogging the feed ports 132.

Fifth Exemplary Embodiment

A light exposure device according to a fifth exemplary embodiment will now be described. In the fifth exemplary embodiment, components or portions the same as those of the first to fourth exemplary embodiments are denoted with the same reference signs without detailed description, and only different components will be described.

Figure 14:
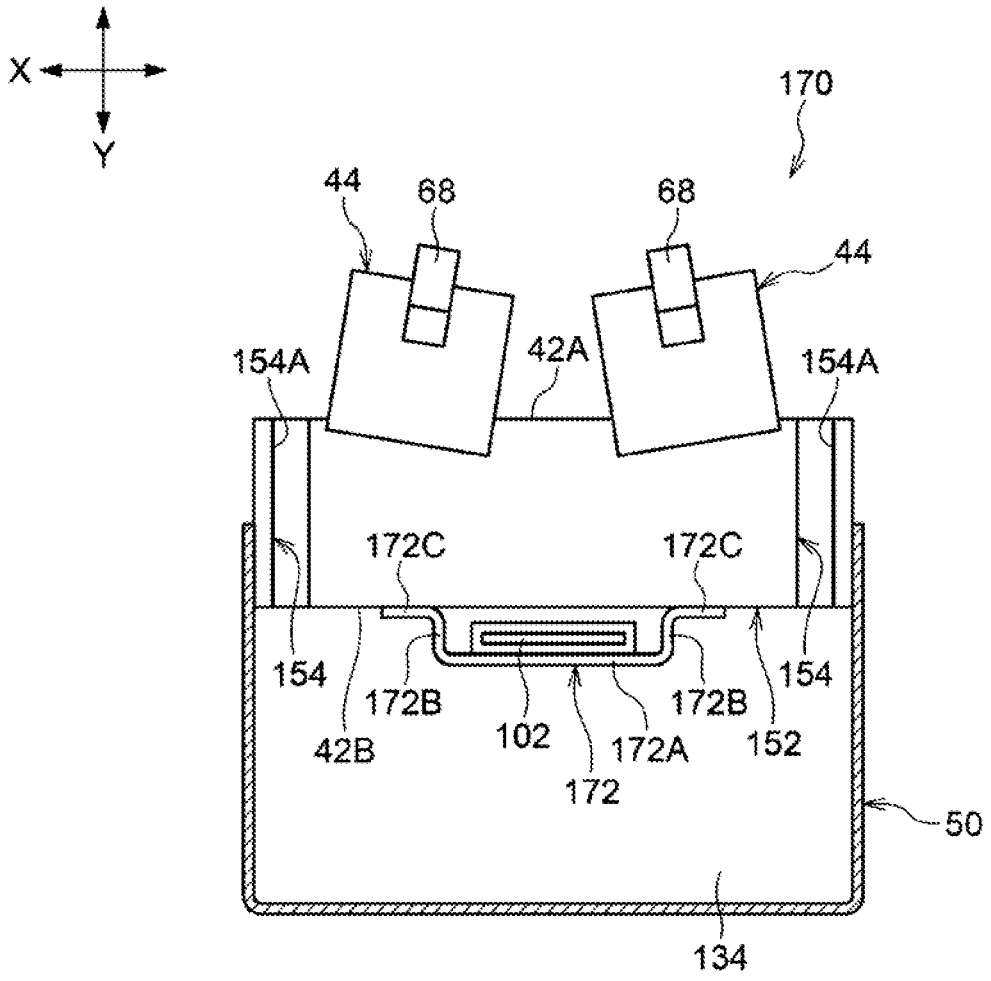
FIG. 14 is a cross-sectional view of a light exposure device according to a fifth exemplary embodiment taken in the cross direction of the base plate.

FIG. 14 illustrates a light exposure device 170 according to a fifth exemplary embodiment. As illustrated in FIG. 14, the light exposure device 170 includes the base plate 152 and a bracket 172 that holds the flat cables 102. The light exposure device 170 has the same components as the light exposure device 150 according to the third exemplary embodiment (refer to FIG. 12) except for the bracket 172 attached to the base plate 152. FIG. 14 is a schematic diagram of the light exposure device 170 for clarifying the structure of the light exposure device 170.

The feed ports 154 are formed on both sides in the width direction of the base plate 152, that is, in the cross direction (direction of arrow X).

The bracket 172 is disposed between the feed ports 154 on both end portions in the width direction of the base plate 152. The bracket 172 is an example of a holding member. Specifically, the bracket 172 is disposed inward from the two feed ports 154 in the width direction of the base plate 152. The bracket 172 includes a bottom surface portion 172A, which is a horizontal surface, a pair of vertical walls 172B bent upward from both end portions of the bottom surface portion 172A, and a pair of attachments 172C bent outward in the width direction of the base plate 42 from the upper end portions of the vertical walls 172B. The pair of attachments 172C are secured to the base plate 152 with fastening members (not illustrated) while being in surface contact with the back surface 42B of the base plate 152.

The vertical walls 172B are shorter than the bottom surface portion 172A. The bottom surface portion 172A is disposed along the back surface 42B of the base plate 152 while being spaced apart from the back surface 42B of the base plate 152. The flat cables 102 connected to the respective light emitting units 44 on the base plate 152 are held on the bottom surface portion 172A of the bracket 172. The flat cables 102 are disposed along the base plate 152 beside the base plate 152 inside the flow path 134. The flat cables 102 are disposed inward from the two feed ports 154 in the width direction of the base plate 152.

The light exposure device 170 has the following operations and effects besides the similar operations and effects of the light exposure device 40 according to the first exemplary embodiment.

In the light exposure device 170, the flat cables 102 extend along the base plate 152 beside the base plate 152 inside the flow path 134. Thus, compared to a structure including wires disposed outward from the base plate in the width direction, the light exposure device 170 including the flat cables 102 disposed beside the base plate 152 inside the flow path 134 facilitates attachment and removal of the lower covering 50.

Sixth Exemplary Embodiment

A light exposure device according to a sixth exemplary embodiment will now be described. In the sixth exemplary embodiment, components or portions the same as those of the first to fifth exemplary embodiments are denoted with the same reference signs without detailed description, and only different components will be described.

Figure 15:
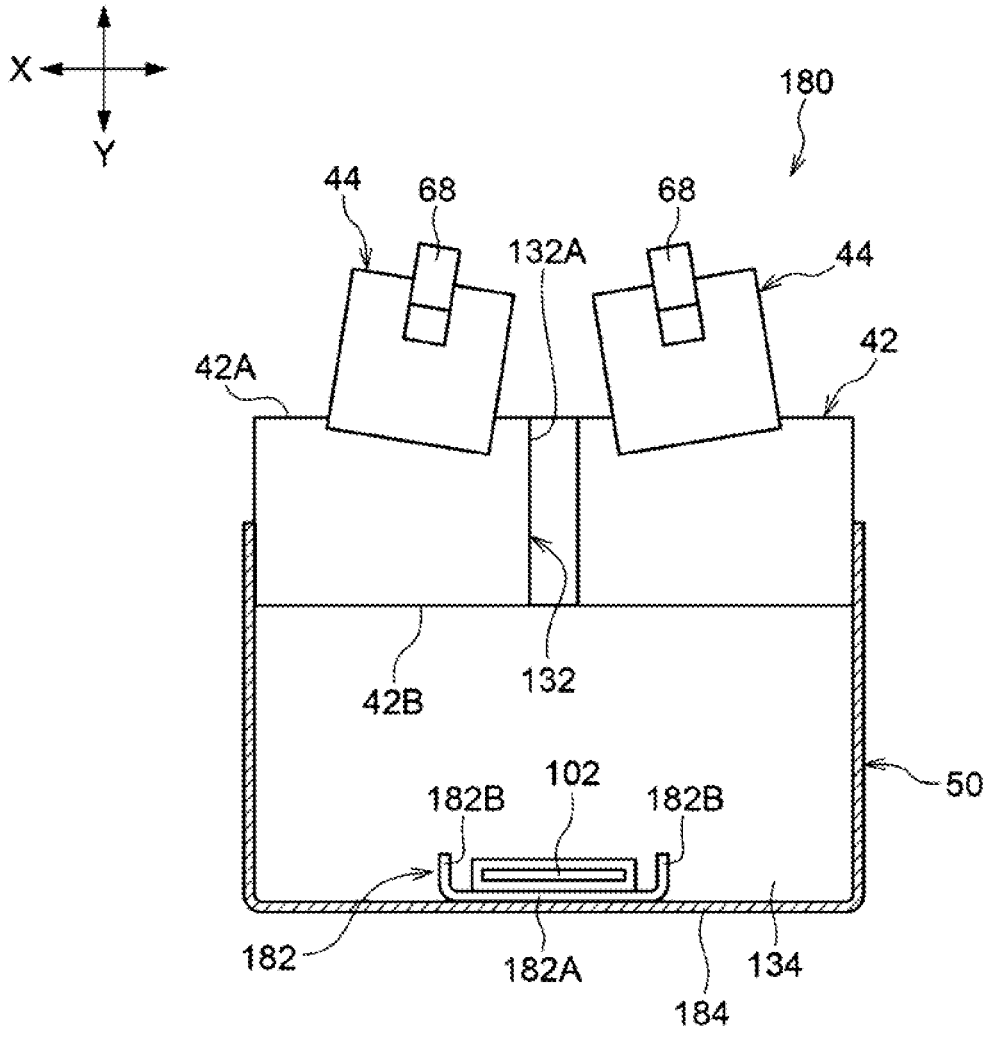
FIG. 15 is a cross-sectional view of a light exposure device according to a sixth exemplary embodiment taken in the cross direction of the base plate.

FIG. 15 illustrates a light exposure device 180 according to a sixth exemplary embodiment. As illustrated in FIG. 15, the light exposure device 180 includes a bracket 182 that holds the flat cables 102. The light exposure device 180 has the same components as the light exposure device 140 according to the second exemplary embodiment except for the bracket 182. FIG. 15 is a schematic diagram of the light exposure device 180 for clarifying the structure of the light exposure device 180.

The bracket 182 is formed from, for example, a belt-shaped member that crosses the first direction of the base plate 42. The bracket 182 is an example of a holding member. The bracket 182 includes a bottom surface portion 182A, which is a horizontal surface, and a pair of bent portions 182B, bent upward from both end portions of the bottom surface portion 182A. The bottom surface portion 182A is secured to the lower covering 50 with attachments (not illustrated) or adhesion while being in surface contact with an upper surface of a bottom surface portion 184 of the lower covering 50.

The flat cables 102 connected to the respective light emitting units 44 on the base plate 42 are held by the bottom surface portion 182A of the bracket 182 attached to the bottom surface portion 184 of the lower covering 50. Specifically, the flat cables 102 are disposed inside the flow path 134 closer to the end away from the base plate 42.

The light exposure device 180 has the following operations and effects besides the similar operations and effects of the light exposure device 40 according to the first exemplary embodiment.

In the light exposure device 180, the flat cables 102 are disposed inside the flow path 134 closer to the end away from the base plate 42. Thus, compared to the structure including wires disposed beside the base plate, the light exposure device 180 prevents the flat cables 102 from clogging the feed ports 132.

Seventh Exemplary Embodiment

Figure 16:
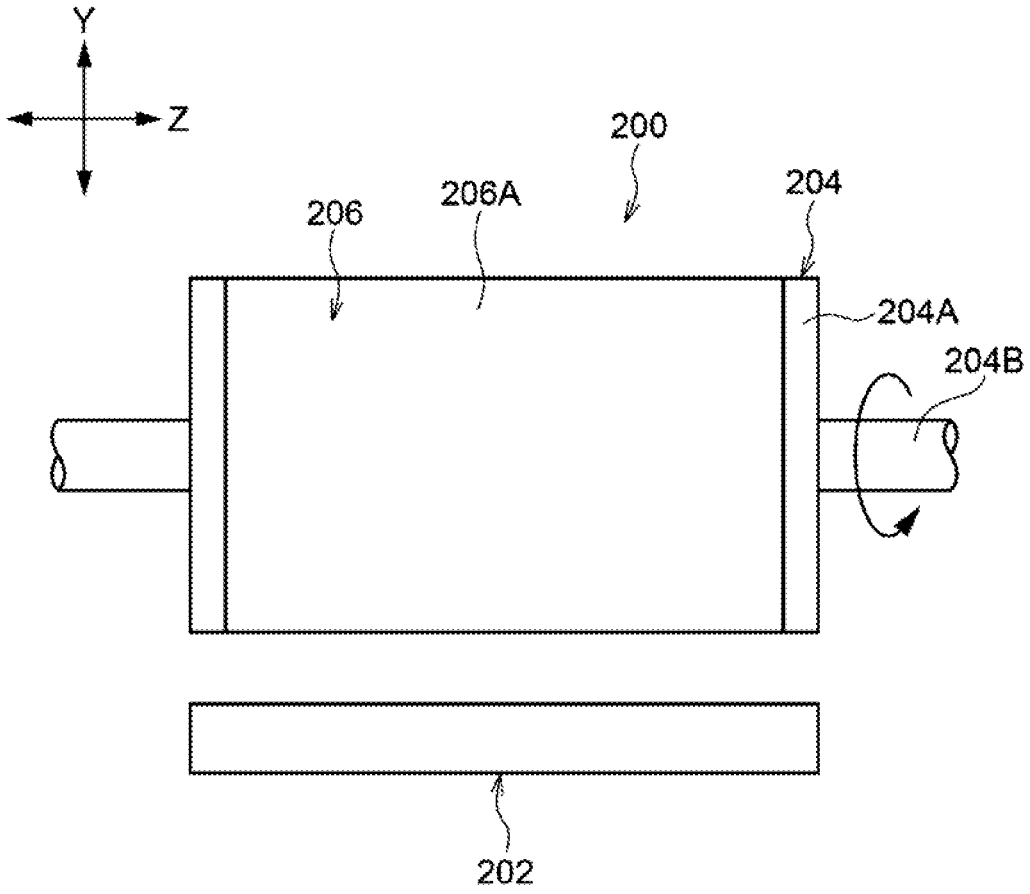
FIG. 16 is a diagram of a structure of a rendering device including a light emitting device according to a seventh exemplary embodiment.

FIG. 16 illustrates a rendering device 200 according to a seventh exemplary embodiment including a light emitting device 202. Components or portions the same as those of the first exemplary embodiment are denoted with the same reference signs without description.

As illustrated in FIG. 16, the rendering device 200 includes the light emitting device 202 and a cylindrical member 204, which extends in the longitudinal direction of the light emitting device 202 and rotates in the circumferential direction.

The light emitting device 202 has the same structure as the light exposure device 40 according to the first exemplary embodiment.

The cylindrical member 204 includes a cylindrical portion 204A and a shaft 204B extending from both sides of the cylindrical portion 204A. The shaft 204B is rotatably supported by a frame, not illustrated. When the shaft 204B rotates, the cylindrical portion 204A rotates in the circumferential direction.

A substrate 206 is attached to the surface of the cylindrical portion 204A. The surface of the substrate 206 has an area 206A over which a photosensitive material is disposed. The substrate 206 is a plate for computer-to-plate (CTP) used in, for example, plate-making in offset printing. The area 206A over which a photosensitive material is disposed is, for example, an area over which a photosensitive material such as a photoresist is applied.

In the rendering device 200, while the cylindrical member 204 is being rotated, the light emitting device 202 irradiates the area 206A of the substrate 206 over which the photosensitive material is disposed with light of a predetermined pattern. Thus, the predetermined pattern is rendered over the area 206A of the substrate 206 over which the photosensitive material is disposed. Thereafter, the substrate 206 is developed to form a printing plate used in an offset printer. Examples usable as a light source of the rendering device 200 include a laser device.

The light emitting device 202 has the following operations and effects besides the similar operations and effects of the light exposure device 40 according to the first exemplary embodiment.

Compared to the structure including wires disposed outward from the base plate of the light emitting unit in the width direction, the rendering device 200 including the light emitting device 202 reduces damages on the flat cables 102 caused when the light emitting device 202 falls sideways during operation.

Compared to the structure including wires disposed outward from the base plate in the width direction, the rendering device 200 including the cylindrical member 204 reduces damages on the flat cables 102 caused when the light emitting device 202 falls sideways during operation.

In the rendering device 200, instead of the light exposure device 40 according to the first exemplary embodiment, the light emitting device 202 may have the same structure as the light exposure device 140, 150, 160, 170, or 180 according to the second, third, fourth, fifth, or sixth exemplary embodiment.

Supplementary Explanation

The light exposure device according to each of the first to sixth exemplary embodiments and the light emitting device according to the seventh exemplary embodiment include three light emitting units on the base plate. However, the present disclosure is not limited to this structure. For example, one, two, four, or more light emitting units may be disposed on the base plate. The positions of multiple light emitting units disposed on the base plate may be determined as appropriate.

In the light exposure device according to each of the first to sixth exemplary embodiments and the light emitting device according to the seventh exemplary embodiment, the base plate is formed from a metal block. However, the present disclosure is not limited to this structure. The material or shape of the base plate may be changed. For example, the base plate may be formed from resin, or other metal such as sheet metal. Components of the light emitting unit or the shapes of the components of the light emitting unit may be changed. The support body of the light emitting unit is formed from a metal block. However, the present disclosure is not limited to this structure. The material or shape of the support body may be changed. For example, the support body may be formed from resin, or other metal such as sheet metal.

In the light exposure devices according to the first to sixth exemplary embodiments and the light emitting device according to the seventh exemplary embodiment, the flat cables 102, serving as examples of wires disposed inside the flow path, are respectively electrically connected to the three light emitting units 44. However, the present disclosure is not limited to this structure. For example, wires disposed inside the flow path may be electrically connected to at least one of multiple light emitting units. Wires may be drawn from the light-emitting-device substrate 62. Alternatively, instead of flat cables, wires may be harnesses or a single wire.

In the light exposure devices according to the first to sixth exemplary embodiments and the light emitting device according to the seventh exemplary embodiment, the shape of the brackets may be changed. For example, in the light exposure device according to the first exemplary embodiment, each bracket 48 has the pair of attachments 48B that are bent inward in the width direction from the upper end portions of the support portion 48A. However, the pair of attachments may be bent outward in the width direction from the upper end portions of the support portion.

In the light exposure devices according to the first to sixth exemplary embodiments and the light emitting device according to the seventh exemplary embodiment, the shape, position, and number of feed ports formed in the base plate may be changed. The shape of the lower covering forming the flow path of the air feeding device, and the position or number of the fan may also be changed.

In the light exposure devices according to the first to sixth exemplary embodiments and the light emitting device according to the seventh exemplary embodiment, the fan disposed on the lower covering introduces air into the flow path, and blows air toward the light emitting unit through the feed ports in the base plate. However, the present disclosure is not limited to this structure. For example, instead of forming feed ports in the base plate (that is, instead of including a mechanism of blowing air from the base plate to the light emitting unit), air may be fed with a mechanism of feeding air in the first direction into the flow path on the back surface of the base plate (that is, a mechanism using the base plate as a heatsink). Alternatively, when using a mechanism of blowing air from the base plate toward the light emitting units, for example, a fan may be disposed on a side covering at the end portion in the width direction of the base plate to suck air and blow air toward the light emitting unit through the feed ports of the base plate.

The light exposure device 150 according to the third exemplary embodiment and the light exposure device 170 according to the fifth exemplary embodiment each include the multiple light emitting units 44 on the base plate 152, and the driving substrates 72 at the inner side portions of the light emitting units 44 in the width direction of the base plate 152. However, the present disclosure is not limited to this structure. For example, a substrate may be disposed on a side portion of each light emitting unit on the outer side in the width direction, and the feed ports 154 on both sides in the width direction of the base plate 152 may be disposed to oppose the substrate. Wires may be disposed along the base plate 152 beside the base plate 152. This structure reduces the size of a holding member that holds the wires, compared to a structure where wires are spaced apart from the base plate.

The rendering device 200 according to the seventh exemplary embodiment irradiates the substrate 206 attached to the cylindrical portion 204A of the cylindrical member 204 with light from the light emitting device 202. However, the present disclosure is not limited to this structure. For example, the light emitting device may irradiate the substrate disposed on a flat table with light, while the light emitting device and the table are moved relative to each other in the direction crossing the first direction of the light emitting device.

In the rendering device 200 according to the seventh exemplary embodiment, the substrate 206 is a plate for CTP for plate-making in offset printing. The light emitting device 202 irradiates with light the area 206A of the substrate over which the photosensitive material is disposed. However, the present disclosure is not limited to this structure. For example, the light emitting device and the rendering device are usable for light exposure for manufacturing a printed wiring board (PWB). For example, a printed wiring board may be manufactured without using a photomask with direct rendering on the substrate to which a photosensitive material such as a photoresist is applied. The substrate may be a rigid circuit board or a flexible circuit board. When a flexible circuit board is used, the flexible circuit board may be subjected to rendering while being rotated and fixed to the cylindrical member 204 illustrated in FIG. 16.

The above light emitting device and rendering device are usable for the purposes to which photolithography is applicable, such as forming a color filter in the process of manufacturing a liquid crystal display (LCD), light exposure of a dry film resist (DFR) in the process of manufacturing a thin film transistor (TFT), light exposure of a dry film resist (DFR) in the process of manufacturing a plasma display panel (PDP), light exposure of a photosensitive material such as a photoresist in the process of manufacturing a semiconductor device, light exposure of a photosensitive material such as a photoresist in the process of plate-making for printing other than offset printing such as gravure printing, and light exposure of a photosensitive material in the process of manufacturing timepiece components. Here, photolithography refers to a technology involving light exposure of the surface of a member on which the photosensitive material is disposed into a pattern, to generate a pattern including an exposed portion and an unexposed portion.

The above light emitting device and rendering device are applicable to a photon-mode photosensitive material, on which information is directly recorded with light exposure, and a heat-mode photosensitive material, on which information is recorded with heat generated by light exposure. Examples usable as a light source of the rendering device 200 include an LED or a laser device depending on a target subjected to light exposure.

The present disclosure has been described in detail using specific exemplary embodiments, but is not limited to these exemplary embodiment. It is obvious for persons having ordinary skill in the art that the exemplary embodiments may be modified in various manners within the scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A light emitting device, comprising:

a base plate extending in a first direction;

a plurality of light emitting units arranged over a front surface of the base plate while being shifted from each other in the first direction, and each including a support body extending in the first direction and a plurality of light sources supported on the support body while being arranged in the first direction;

a flow path disposed on a side of the base plate opposite to a side facing the light emitting units to feed air therethrough in the first direction;

a wire electrically connected to at least one of the plurality of the light emitting units, and disposed inside the flow path; and an air blower that blows, from the front surface of the base plate toward the light emitting units, air fed from the flow path.

2. The light emitting device according to claim 1, wherein the wire is disposed inside the flow path to extend in the first direction.

3. The light emitting device according to claim 2, further comprising:

a holding member that holds the wire in the flow path, the holding member being disposed on the base plate.

4. The light emitting device according to claim 1, wherein the air blower includes a feed port that is formed in the base plate and that feeds air from the flow path toward the light emitting units.

5. The light emitting device according to claim 4, wherein the feed port extends from the back surface of the base plate to the front surface of the base plate on which the light emitting units are disposed.

6. The light emitting device according to claim 4, wherein the flow path comprises a first end near the base plate and a second end opposite to the first end, wherein the wire is disposed inside the flow path closer to the second end than the first end.

7. The light emitting device according to claim 4, wherein the feed port is formed at a middle portion in a width direction of the base plate crossing the first direction, and wherein the wire is disposed inside the flow path closer to a side surface of the flow path in the width direction.

8. The light emitting device according to claim 4, wherein the wire is a flat cable, and vertically extends inside the flow path.

9. The light emitting device according to claim 8, wherein the wire extends inside the flow path, along the base plate, and beside the base plate.

10. The light emitting device according to claim 4, wherein the feed port is formed at a middle portion in a width direction of the base plate crossing the first direction, and wherein the wire is disposed along the base plate, beside the base plate, and outward from the feed port in the width direction inside the flow path.

11. The light emitting device according to claim 4, wherein the feed port is located to oppose a substrate disposed on a side portion of each of the light emitting units, and wherein the wire is disposed inward from the feed port in a width direction crossing the first direction to extend along the base plate and beside the base plate.

12. The light emitting device according to claim 2, wherein the air blower includes a feed port that is formed in the base plate and that feeds air from the flow path toward the light emitting units.

13. A rendering device, comprising:

the light emitting device according to claim 1; and an area over which a photosensitive material that is irradiated with light by the light emitting device is disposed, the area moving relative to the light emitting device in a direction crossing the first direction.

14. The rendering device according to claim 13, wherein the area is disposed on a surface of a cylindrical member that rotates in a circumferential direction.

15. A light emitting device, comprising:

a base plate extending in a first direction;

a plurality of light emitting units arranged over a front surface of the base plate while being shifted from each other in the first direction, and each including a support body extending in the first direction and a plurality of light sources supported on the support body while being arranged in the first direction;

a flow path disposed on a side of the base plate opposite to a side facing the light emitting units to feed air therethrough in the first direction; and a wire electrically connected to at least one of the plurality of the light emitting units, and disposed inside the flow path, wherein the base plate is formed from a metal block.

16. A light emitting device, comprising:

a base plate extending in a first direction;

a plurality of light emitting units arranged over a front surface of the base plate while being shifted from each other in the first direction, and each including a support body extending in the first direction and a plurality of light sources supported on the support body while being arranged in the first direction;

a flow path disposed on a side of the base plate opposite to a side facing the light emitting units to feed air therethrough in the first direction; and a wire electrically connected to at least one of the plurality of the light emitting units, and disposed inside the flow path, wherein the support body is formed from a metal block.

17. The light emitting device according to claim 16, wherein each of the light emitting units includes a light emitting device on a surface of the support body opposite to a surface facing the base plate.

* * * * *